US008126384B2

(12) United States Patent
Baba

(10) Patent No.: US 8,126,384 B2
(45) Date of Patent: Feb. 28, 2012

(54) FIXING DEVICE AND IMAGE FORMING APPARATUS

(75) Inventor: Motofumi Baba, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 70 days.

(21) Appl. No.: 12/628,039

(22) Filed: Nov. 30, 2009

(65) Prior Publication Data

US 2010/0215415 A1 Aug. 26, 2010

(30) Foreign Application Priority Data

Feb. 24, 2009 (JP) ..... 2009-041362

(51) Int. Cl.
*G03G 15/20* (2006.01)

(52) U.S. Cl. ..... 399/329; 399/328

(58) Field of Classification Search ..... 399/33, 399/328, 329, 330, 334, 335
See application file for complete search history.

(56) References Cited

U.S. PATENT DOCUMENTS 6,819,904 B2 * 11/2004 Terada et al. ..... 399/328
(Continued)

FOREIGN PATENT DOCUMENTS

JP 2003-186322 A 7/2003
(Continued)

*Primary Examiner* — Sandra Brase
(74) *Attorney, Agent, or Firm* — Sughrue Mion, PLLC

(57) ABSTRACT

The fixing device includes: a fixing member having a conductive layer, and fixing toner onto a recording medium by heat generation of the conductive layer through electromagnetic induction; a magnetic field generating member generating an alternate-current magnetic field crossing the conductive layer; a magnetic path forming member arranged so as to face the magnetic field generating member through the fixing member, forming a magnetic path of the alternate-current magnetic field within a temperature range not greater than a permeability change start temperature where permeability starts to decrease, and causing the alternate-current magnetic field to go through the magnetic path forming member within a temperature range exceeding the permeability change start temperature; and a heat radiation member in contact with the magnetic path forming member to radiate heat generated in the magnetic path forming member toward a direction opposite to the fixing member with reference to the magnetic path forming member.

13 Claims, 17 Drawing Sheets

U.S. PATENT DOCUMENTS

| | | | | |
|---|---|---|---|---|
| 7,099,616 | B2 * | 8/2006 | Kato et al. | 399/328 |
| 7,197,270 | B2 * | 3/2007 | Kato et al. | 399/328 |
| 7,268,327 | B2 * | 9/2007 | Yamamoto et al. | 399/328 X |
| 7,386,243 | B2 * | 6/2008 | Kinouchi et al. | 399/328 X |
| 2003/0095818 | A1 | 5/2003 | Nakayama | |
| 2005/0244199 | A1 | 11/2005 | Nakayama | |
| 2006/0213896 | A1 * | 9/2006 | Nanjo | 219/216 |
| 2008/0124111 | A1 | 5/2008 | Baba et al. | |
| 2009/0028617 | A1 * | 1/2009 | Katakabe et al. | 399/328 X |

FOREIGN PATENT DOCUMENTS

| | | | |
|---|---|---|---|
| JP | 2008-152247 | A | 7/2008 |

* cited by examiner z1
z
x
y
64a
64
66
65

64
64a
66
g
x
y 64
64a
66a
66
g
x
y z3
z1
z2
z
x
y
66d
64
66
65 g

FIXING DEVICE AND IMAGE FORMING APPARATUS

CROSS REFERENCE TO RELATED APPLICATIONS

This application is based on and claims priority under 35 USC §119 from Japanese Patent Application No. 2009-041362 filed Feb. 24, 2009.

BACKGROUND

1. Technical Field

The present invention relates to a fixing device and an image forming apparatus.

2. Related Art

Fixing devices using an electromagnetic induction heating method are known as the fixing devices each to be installed in an image forming apparatus such as a copy machine and a printer using an electrophotographic method.

SUMMARY

According to an aspect of the present invention, there is provided a fixing device comprising: a fixing member that has a conductive layer, and that fixes toner onto a recording medium by heat generation of the conductive layer through electromagnetic induction; a magnetic field generating member that generates an alternate-current magnetic field crossing the conductive layer of the fixing member; a magnetic path forming member that is arranged so as to face the magnetic field generating member through the fixing member, that forms a magnetic path of the alternate-current magnetic field generated by the magnetic field generating member within a temperature range not greater than a permeability change start temperature at which permeability starts to decrease, and that causes the alternate-current magnetic field generated by the magnetic field generating member to go through the magnetic path forming member within a temperature range exceeding the permeability change start temperature; and a heat radiation member that is arranged to be in contact with the magnetic path forming member in order to radiate heat generated in the magnetic path forming member toward a direction opposite to the fixing member with reference to the magnetic path forming member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below in detail with reference to the accompanying drawings.

<Description of Image Forming Apparatus>

Figure 1:
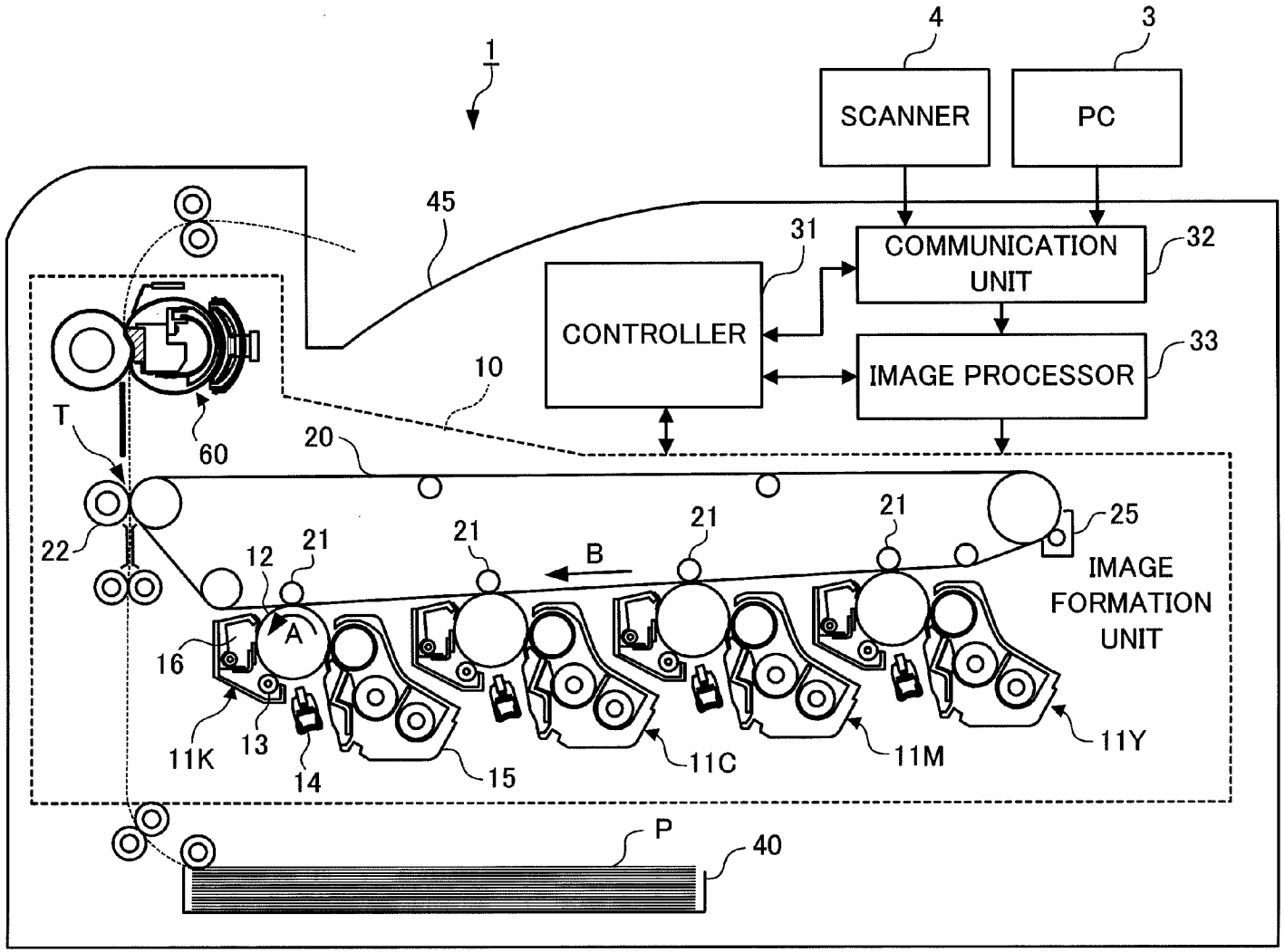
FIG. 1 is a diagram showing a configuration example of an image forming apparatus to which a fixing device of the exemplary embodiments is applied.

FIG. 1 is a diagram showing a configuration example of an image forming apparatus to which a fixing device of the exemplary embodiments is applied. An image forming apparatus 1 shown in FIG. 1 is a so-called tandem-type color printer, and includes: an image forming portion 10 that performs image forming on the basis of image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image forming portion 10 includes four image forming units 11Y, 11M, 11C and 11K (also collectively referred to as an "image forming unit 11") as examples of a toner image forming unit, which are arranged side by side at certain intervals. Each of the image forming units 11 includes: a photoconductive drum 12 as an example of an image carrier that forms an electrostatic latent image and holds a toner image; a charging device 13 that uniformly charges the surface of the photoconductive drum 12 at a predetermined potential; a light emitting diode (LED) print head 14 that exposes, on the basis of color image data, the photoconductive drum 12 charged by the charging device 13; a developing device 15 that develops the electrostatic latent image formed on the photoconductive drum 12; and a cleaner 16 that cleans the surface of the photoconductive drum 12 after a transfer.

The image forming units 11 have almost the same configuration except toner contained in the developing device 15, and form yellow (Y), magenta (M), cyan (C) and black (K) color toner images, respectively.

Further, the image forming portion 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in respective image forming units 11 onto the intermediate transfer belt 20. Furthermore, the image forming portion 10 includes: a secondary transfer roll 22 that collectively transfers (secondarily transfers) the color toner images superimposingly transferred onto the intermediate transfer belt 20 onto a sheet P which is a recording medium (recording sheet); and a fixing unit 60 as an example of a fixing unit (a fixing device) that fixes the color toner images having been secondarily transferred, onto the sheet P. Note that, in the image forming apparatus 1 according to the exemplary embodiments, the intermediate transfer belt 20, the primary transfer rolls 21 and the secondary transfer roll 22 configure a transfer unit.

In the image forming apparatus 1 of the exemplary embodiments, image formation processing using the following processes is performed under operations controlled by the controller 31. Specifically, image data from the PC 3 or the scanner 4 is received by the communication unit 32, and after the image data is subjected to certain image processing performed by the image processor 33, the image data of each color is generated and sent to a corresponding one of the image forming units 11. Then, in the image forming unit 11K that forms a black-color (K) toner image, for example, the photoconductive drum 12 is uniformly charged by the charging device 13 at the potential set in advance while rotating in a direction of an arrow A, and then is exposed by the LED print head 14 on the basis of the black color image data transmitted from the image processor 33. Thereby, an electrostatic latent image for the black-color image is formed on the photoconductive drum 12. The black-color electrostatic latent image formed on the photoconductive drum 12 is then developed by the developing device 15. Then, the black-color toner image is formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11 are electrostatically transferred (primarily transferred), in sequence, onto the intermediate transfer belt 20 that moves in a direction of an arrow B, by the primary transfer rolls 21. Then, superimposed toner images on which the color toner images are superimposed on one another are formed. Then, the superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at a timing when the superimposed toner images being transported arrive at the secondary transfer portion T. Then, the superimposed toner images are collectively and electrostatically transferred (secondarily transferred) onto the transported sheet P by action of a transfer electric field formed at the secondary transfer portion T by the secondary transfer roll 22.

Thereafter, the sheet P onto which the superimposed toner images are electrostatically transferred is transported to the fixing unit 60. The toner images on the sheet P transported to the fixing unit 60 are heated and pressurized by the fixing unit 60 and thereby are fixed onto the sheet P. Then, the sheet P including the fixed images formed thereon is transported to a sheet output unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the respective cleaners 16 and a belt cleaner 25.

In this way, the image formation processing in the image forming apparatus 1 is repeatedly performed for a designated number of print sheets.

<Description of Configuration of Fixing Unit>

Next, a description will be given of the fixing unit 60 in the exemplary embodiments.

Figure 2:
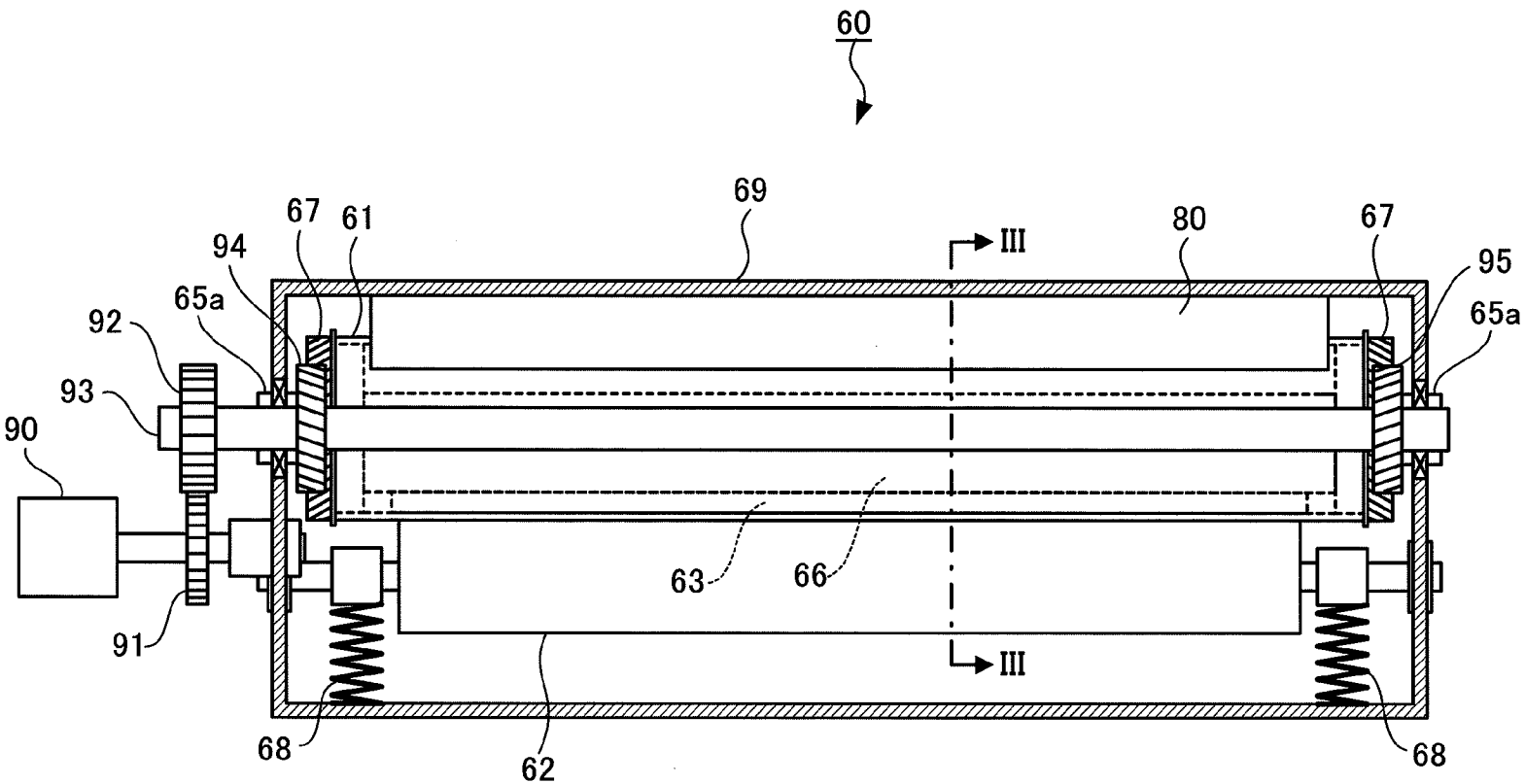
FIG. 2 is a front view of the fixing unit of the exemplary embodiments.
Figure 3:
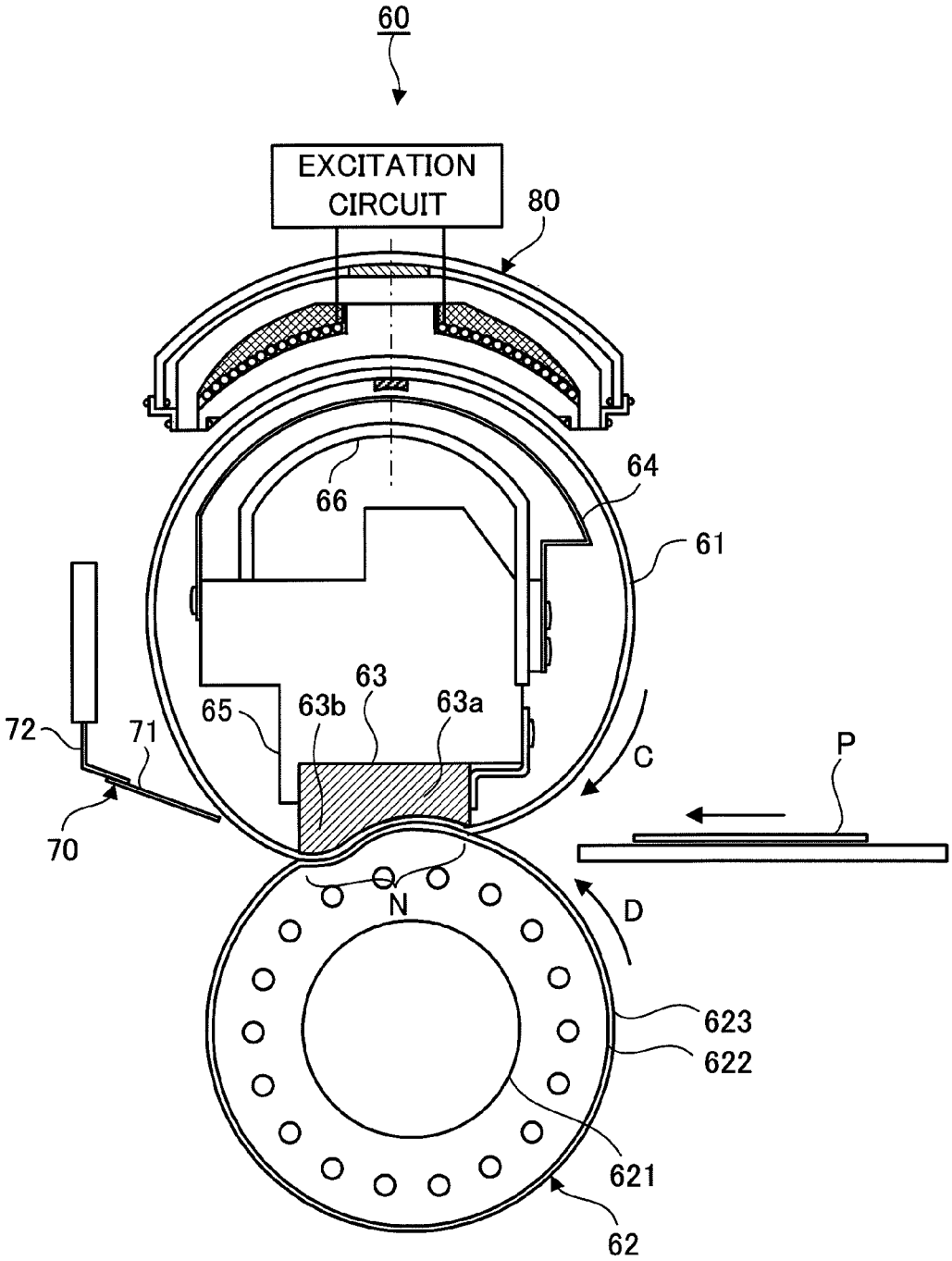
FIG. 3 is a cross sectional view of the fixing unit, taken along the line III-III in FIG. 2.

FIGS. 2 and 3 are diagrams showing a configuration of the fixing unit 60 of the exemplary embodiments. FIG. 2 is a front view of the fixing unit 60, and FIG. 3 is a cross sectional view of the fixing unit 60, taken along the line III-III in FIG. 2.

Firstly, as shown in FIG. 3, which is a cross sectional view, the fixing unit 60 includes: an induction heating (IH) heater 80 as an example of a magnetic field generating member that generates an AC (alternate-current) magnetic field; a fixing belt 61 as an example of a fixing member that is subjected to electromagnetic induction heating by the IH heater 80, and thereby fixes a toner image; a pressure roll 62 that is arranged so as to face the fixing belt 61; and a pressing pad 63 that is pressed by the pressure roll 62 with the fixing belt 61 therebetween.

The fixing unit 60 further includes: a holder 65 that supports a constituent member such as the pressing pad 63 and the like; a temperature-sensitive magnetic member 64 that forms a magnetic path by inducing the AC magnetic field generated at the IH heater 80; an induction member 66 that induces magnetic field lines passing through the temperature-sensitive magnetic member 64; and a peeling assisting member 70 that assists peeling of the sheet P from the fixing belt 61.

<Description of Fixing Belt>

Figure 4:
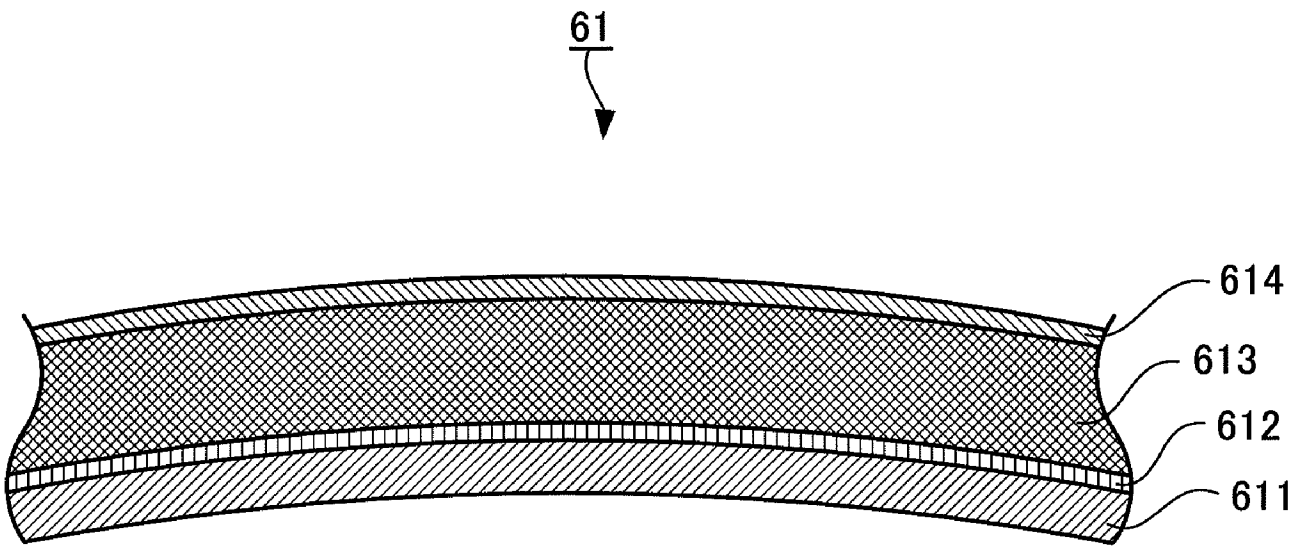
FIG. 4 is a configuration diagram showing cross sectional layers of the fixing belt.

The fixing belt 61 is formed of an endless belt member originally formed into a cylindrical shape, and is formed with a diameter of 30 mm and a width-direction length of 370 mm in the original shape (cylindrical shape), for example. In addition, as shown in FIG. 4 (a configuration diagram showing cross sectional layers of the fixing belt 61), the fixing belt 61 is a belt member having a multi-layer structure including: a base layer 611; a conductive heat-generating layer 612 that is coated on the base layer 611; an elastic layer 613 that improves fixing properties of a toner image; and a surface release layer 614 that is applied as the uppermost layer.

The base layer 611 is formed of a heat-resistant sheet-like member that supports the conductive heat-generating layer 612, which is a thin layer, and that gives a mechanical strength to the entire fixing belt 61. Moreover, the base layer 611 is formed of a specified material with a specified thickness. The base layer material has properties (relative permeability, specific resistance) that allow a magnetic field to pass therethrough so that the AC magnetic field generated at the IH heater 80 may act on the temperature-sensitive magnetic member 64. Meanwhile, the base layer 611 itself is formed so as not to generate heat by action of the magnetic field or not to easily generate heat.

Specifically, for example, a non-magnetic metal such as a non-magnetic stainless steel having a thickness of 30 to 200 μm (preferably, 50 to 150 μm), or a resin material or the like having a thickness of 60 to 200 μm is used as the base layer 611.

The conductive heat-generating layer 612 is an example of a conductive layer and is an electromagnetic induction heat-generating layer that is self-heated by electromagnetic induction of the AC magnetic field generated at the IH heater 80. Specifically, the conductive heat-generating layer 612 is a layer that generates an eddy current when the AC magnetic field from the IH heater 80 passes therethrough in the thickness direction.

Normally, an inexpensively manufacturable general-purpose power supply is used as the power supply for an excitation circuit 88 that supplies an AC current to the IH heater 80 (also refer to later-described FIG. 6). For this reason, in general, a frequency of the AC magnetic field generated by the IH heater 80 ranges from 20 kHz to 100 kHz by use of the general-purpose power supply. Accordingly, the conductive heat-generating layer 612 is formed to allow the AC magnetic field having a frequency of 20 kHz to 100 kHz to enter and to pass therethrough.

A region of the conductive heat-generating layer 612, where the AC magnetic field is allowed to enter is defined as a skin depth δ representing a region where the AC magnetic field attenuates to 1/e. The skin depth δ is calculated by use of the following formula (1), where f is a frequency of the AC magnetic field (20 kHz, for example), ρ is a specific resistance value (Ω·m), and $\mu_r$ is a relative permeability.

Accordingly, in order to allow the AC magnetic field having a frequency of 20 kHz to 100 kHz to enter and then to pass through the conductive heat-generating layer 612, the thickness of the conductive heat-generating layer 612 is formed to be smaller than the skin depth δ of the conductive heat-generating layer 612, which is defined by the formula (I). In addition, as the material that forms the conductive heat-generating layer 612, a metal such as Au, Ag, Al, Cu, Zn, Sri, Pb, Bi, Be or Sb, or a metal alloy including at least one of these elements is used, for example.

$$\delta = 503\sqrt{\frac{\rho}{f \cdot \mu_r}} \quad (1)$$

Specifically, as the conductive heat-generating layer 612, a non-magnetic metal (paramagnetic material having a relative permeability substantially equal to 1) including Cu or the like, having a thickness of 2 to 20 μm and a specific resistance value not greater than $2.7\times10^{-8}$ Ωm is used, for example.

In addition, in view of shortening the period of time required for self-heating the fixing belt 61 to reach a fixation setting temperature (hereinafter, referred to as a "warm-up time") as well, the conductive heat-generating layer 612 may be formed of a thin layer.

Next, the elastic layer 613 is formed of a heat-resistant elastic material such as a silicone rubber. The toner image to be held on the sheet P, which is to become the fixation target, is formed of a multi-layer of color toner as powder. For this reason, in order to uniformly supply heat to the entire toner image at a nip portion N, the surface of the fixing belt 61 may particularly be deformed so as to correspond with unevenness of the toner image on the sheet P. In this respect, a silicone rubber having a thickness of 100 to 600 μm and a hardness of 10° to 30° (JIS-A), for example, may be used for the elastic layer 613.

The surface release layer 614 directly contacts with an unfixed toner image held on the sheet P. Accordingly, a material with a high releasing property is used. For example, a PFA (a copolymer of tetrafluoroethylene and perfluoroalkylvinylether) layer, a PTFE (polytetrafluoroethylene) layer or a silicone copolymer layer or a composite layer formed of these layers is used. As to the thickness of the surface release layer 614, if the thickness is too small, no sufficient abrasion resistance is obtained, hence, reducing the life of the fixing belt 61. On the other hand, if the thickness is too large, the heat capacity of the fixing belt 61 becomes so large that the warm-up time becomes longer. In this respect, the thickness of the surface release layer 614 may be particularly 1 to 50 μm in consideration of the balance between the abrasion resistance and heat capacity.

<Description of Pressing Pad>

The pressing pad 63 is formed of an elastic material such as a silicone rubber or fluorine-contained rubber, and is supported by the holder 65 at a position facing the pressure roll 62. Then, the pressing pad 63 is arranged in a state of being pressed by the pressure roll 62 with the fixing belt 61 therebetween, and forms the nip portion N with the pressure roll 62.

In addition, the pressing pad 63 has different nip pressures set for a pre-nip region 63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressure roll 62 side is formed into a circular arc shape approximately corresponding with the outer circumferential surface of the pressure roll 62, and the nip portion N, which is uniform and wide, is formed. Moreover, a surface of the peeling nip region 63*b* at the pressure roll 62 side is formed into a shape so as to be locally pressed with a larger nip pressure from the surface of the pressure roll 62 in order that a curvature radius of the fixing belt 61 passing through the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61.

Note that, in the exemplary embodiments, the peeling assisting member 70 is arranged at the downstream side of the nip portion N as an assistance unit for the peeling of the sheet P by the pressing pad 63. In the peeling assisting member 70, a peeling baffle 71 is supported by a holder 72 in a state of being positioned to be close to the fixing belt 61 in a direction opposite to the rotational moving direction of the fixing belt 61 (so-called counter direction). Then, the peeling baffle 71 supports the curl portion formed on the sheet P at the exit of the pressing pad 63, thereby preventing the sheet P from moving toward the fixing belt 61.

<Description of Temperature-Sensitive Magnetic Member>

Next, the temperature-sensitive magnetic member 64 is formed into a circular arc shape corresponding with an inner circumferential surface of the fixing belt 61 and is arranged to be close to, but not to be in contact with the inner circumferential surface of the fixing belt 61 so as to have a predetermined gap (0.5 to 1.5 mm, for example) with the inner circumferential surface of the fixing belt 61. The reason for arranging the temperature-sensitive magnetic member 64 so as to be close to the fixing belt 61 is to achieve a configuration in which the temperature of the temperature-sensitive magnetic member 64 changes in accordance with the temperature of the fixing belt 61, that is, the temperature of the temperature-sensitive magnetic member 64 becomes substantially equal to the temperature of the fixing belt 61. In addition, the reason for arranging the temperature-sensitive magnetic member 64 so as not to be in contact with the fixing belt 61 is to suppress heat of the fixing belt 61 flowing into the temperature-sensitive magnetic member 64 when the fixing belt 61 is self-heated up to the fixation setting temperature after a main switch of the image forming apparatus 1 is turned on, and thereby to achieve shortening of the warm-up time.

Moreover, the temperature-sensitive magnetic member 64 is formed of a material whose "permeability change start temperature" (refer to later part of the description) at which the permeability of the magnetic properties drastically changes is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 64 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 64 functions as a magnetic path forming member that forms a magnetic path in the temperature-sensitive magnetic member 64 within a temperature range not greater than the permeability change start temperature, where the temperature-sensitive magnetic member 64 has the ferromagnetic property. Further, within the temperature range not greater than the permeability change start temperature, the temperature-sensitive magnetic member 64 induces magnetic field lines generated by the IH heater 80 and going through the fixing belt 61 to the inside thereof, and forms a magnetic path so that the magnetic field lines may pass through the inside of the temperature-sensitive magnetic member 64. Thereby, the temperature-sensitive magnetic member 64 forms a closed magnetic path that internally wraps the fixing belt 61 and an excitation coil 82 (refer to later-described FIG. 6) of the IH heater 80. Meanwhile, within a temperature range exceeding the permeability change start temperature, the temperature-sensitive magnetic member 64 causes the magnetic field lines generated by the IH heater 80 and going through the fixing belt 61 to go therethrough so as to run across the temperature-sensitive magnetic member 64 in the thickness direction of the temperature-sensitive magnetic member 64. Then, the magnetic field lines generated by the IH heater 80 and going through the fixing belt 61 form a magnetic path in which the magnetic field lines go through the temperature-sensitive magnetic member 64, pass through the inside of the induction member 66, and then return to the III heater 80.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 64 starts to change, for example. Accordingly, the permeability change start temperature is a temperature close to the Curie point, which is a temperature at which the magnetic property is lost, but is a temperature with a concept different from the Curie point.

Examples of the material of the temperature-sensitive magnetic member 64 include a binary component Fe—Ni alloy or a ternary component Fe—Ni—Cr alloy such as permalloys, magnetic compensator alloys flux or the like whose permeability change start temperature is set within a range of 140 degrees C. (the fixation setting temperature) to 240 degrees C. For example, the permeability change start temperature may be set around 225 degrees C. by setting the ratios of Fe and Ni at approximately 64% and 36% (atom number ratio), respectively, in a binary magnetic compensator alloys flux of Fe—Ni. The aforementioned metal alloys or the like including the permalloy and the magnetic compensator alloys flux are suitable for the temperature-sensitive magnetic member 64 since they are excellent in formability and workability, and a high heat conductivity as well as less expensive costs. Another example of the material includes a metal alloy made of Fe, Ni, Si, B, Nb, Cu, Zr, Co, Cr, V, Mn, Mo or the like.

In addition, the temperature-sensitive magnetic member 64 is formed with a thickness smaller than the skin depth δ (refer to the formula (1) described above) with respect to the AC magnetic field (magnetic field lines) generated by the IH heater 80. Specifically, a thickness of approximately 50 to 300 μm is set when a Fe—Ni alloy is used as the material, for example. Note that, the configuration and the function of the temperature-sensitive magnetic member 64 will be described later in detail.

<Description of Holder>

The holder 65 that supports the pressing pad 63 is formed of a material having a high rigidity so that the amount of deflection in a state where the pressing pad 63 receives pressing force from the pressure roll 62 may be a certain amount or less. In this manner, the amount of pressure (nip pressure N) at the nip portion N in the longitudinal direction is kept uniform. Moreover, since the fixing unit 60 of the exemplary embodiments employs a configuration in which the fixing belt 61 is self-heated by use of electromagnetic induction, the holder 65 is made of a material that provides no influence or hardly provides influence on an induction magnetic field, and that is not influenced or is hardly influenced by the induction magnetic field. For example, a heat-resistant resin such as glass mixed PPS (polyphenylene sulfide), or a paramagnetic metal material such as Al, Cu or Ag is used.

<Description of Induction Member>

The induction member 66 is formed into a circular arc shape corresponding with the inner circumferential surface of the temperature-sensitive magnetic member 64 and is arranged so as not to be in contact with the inner circumferential surface of the temperature-sensitive magnetic member 64. Here, the induction member 66 has a gap set in advance (1.0 to 5.0 mm, for example) with the inner circumferential surface of the temperature-sensitive magnetic member 64. The induction member 66 is formed of, for example, a non-magnetic metal such as Ag, Cu and Al having a relatively small specific resistance. When the temperature of temperature-sensitive magnetic member 64 increases to a temperature not less than the permeability change start temperature, the induction member 66 induces an AC magnetic field (magnetic field lines) generated by the IH heater 80 and thereby forms a state where an eddy current I is more easily generated in comparison with the conductive heat generating layer 612 of the fixing belt 61. For this reason, the thickness of the induction member 66 is formed to be a predetermined thickness (1.0 mm, for example) sufficiently larger than the skin depth δ (refer to the aforementioned formula (I)) so as to allow the eddy current I to easily flow therethrough.

<Description of Drive Mechanism of Fixing Belt>

Next, a description will be given of a drive mechanism of the fixing belt 61.

As shown in FIG. 2, which is a front view, end caps 67 are secured to both ends in the axis direction of the holder 65 (refer to FIG. 3), respectively. The end caps 67 rotationally drive the fixing belt 61 in a circumferential direction while keeping cross sectional shapes of both ends of the fixing belt 61 in a circular shape. Then, the fixing belt 61 directly receives rotational drive force via the end caps 67 at the both ends and rotationally moves at, for example, a process speed of 140 minis in a direction of an arrow C in FIG. 3

Figure 5A:
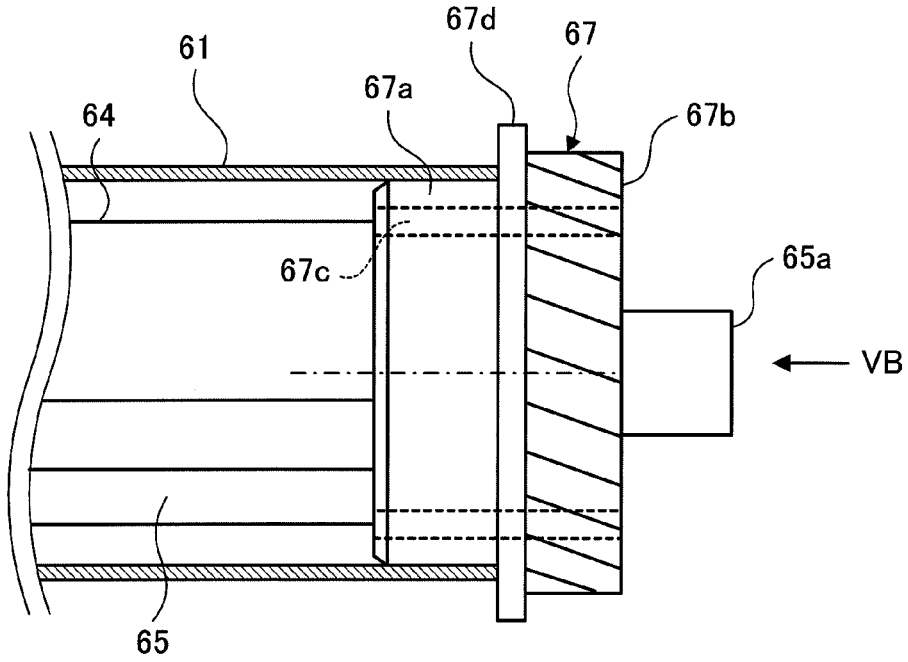
FIG. 5A is a side view of one of the end caps.
Figure 5B:
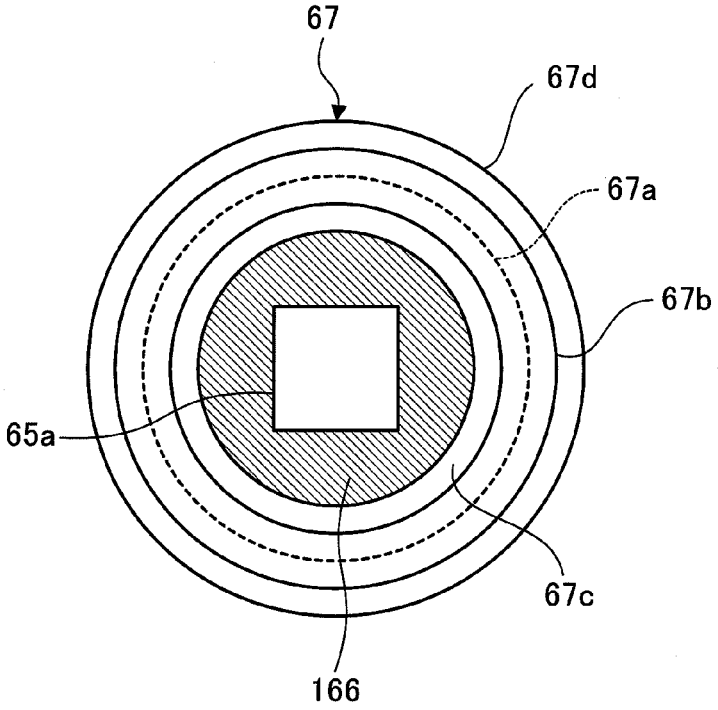
FIG. 5B is a plain view of the end cap when viewed from a VB direction of FIG. 5A.

Here, FIG. 5A is a side view of one of the end caps 67, and FIG. 5B is a plain view of the end cap 67 when viewed from a VB direction of FIG. 5A. As shown in FIGS. 5A and 5B, the end cap 67 includes: a fixing portion 67*a* that is fitted into the inside of a corresponding one of the ends of the fixing belt 61; a flange 67*d* that has an outer diameter larger than that of the fixing portion 67*a* and that is formed so as to project from the fixing belt 61 in the radial direction when attached to the fixing belt 61; a gear 67*b* to which the rotational drive force is transmitted; and a bearing unit 67*c* that is rotatably connected to a support member 65*a* formed at a corresponding one of the ends of the holder 65 with a connection member 166 interposed therebetween. Then, as shown in FIG. 2, the support members 65*a* at the both ends of the holder 65 (refer to FIG. 3) are secured onto the both ends of a chassis 69 of the fixing unit 60, respectively, thereby, supporting the end caps 67 so as to be rotatable with the bearing units 67*c* respectively connected to the support members 65*a*.

As the material of the end caps 67, so-called engineering plastics having a high mechanical strength or heat-resistant properties is used. For example, a phenol resin, polyimide resin, polyamide resin, polyamide-imide resin, PEEK resin, PES resin, PPS resin, LCP resin or the like is suitable. Then, as shown in FIG. 2, in the fixing unit 60, rotational drive force from a drive motor 90 is transmitted to a shaft 93 via transmission gears 91 and 92. The rotational drive force is then transmitted from transmission gears 94 and 95 connected to the shaft 93 to the gears 67*b* of the respective end caps 67 (refer to FIGS. 5A and 5B). Thereby, the rotational drive force is transmitted from the end caps 67 to the fixing belt 61, and the end caps 67 and the fixing belt 61 are integrally driven to rotate.

As described above, the fixing belt 61 directly receives the drive force at the both ends of the fixing belt 61 to rotate, thereby rotating stably.

Here, a torque of approximately 0.1 to 0.5 Nm is generally exerted when the fixing belt 61 directly receives the drive force from the end caps 67 at the both ends thereof and then rotates. However, in the fixing belt 61 of the exemplary embodiments, the base layer 611 is formed of, for example, a non-magnetic stainless steel having a high mechanical strength. Thus, buckling or the like does not easily occur on the fixing belt 61 even when a torsional torque of approximately 0.1 to 0.5 Nm is exerted on the entire fixing belt 61.

In addition, the fixing belt 61 is prevented from inclining or leaning to one direction by the flanges 67*d* of the end caps 67, but at this time, compressive force of approximately 1 to 5 N is exerted toward the axis direction from the ends (flanges 67*d*) on the fixing belt 61 in general. However, even in a case where the fixing belt 61 receives such compressive force, the occurrence of buckling or the like is prevented since the base layer 611 of the fixing belt 61 is formed of a non-magnetic stainless steel or the like.

As described above, the fixing belt 61 of the exemplary embodiments receives the drive force directly at the both ends of the fixing belt 61 to rotate, thereby, rotating stably. In addition, the base layer 611 of the fixing belt 61 is formed of, for example, a non-magnetic stainless steel or the like having a high mechanical strength, hence providing the configuration in which buckling or the like caused by a torsion torque or compressive force does not easily occur in this case. Moreover, the softness and flexibility of the entire faxing belt 61 is obtained by forming the base layer 611 and the conductive heat-generating layer 612 respectively as thin layers, so that the fixing belt 61 is deformed so as to correspond with the nip portion N and recovers to the original shape.

With reference back to FIG. 3, the pressure roll 62 is arranged to face the fixing belt 61 and rotates at, for example, a process speed of 140 mm/s in the direction of an arrow D in FIG. 3 while being driven by the fixing belt 61. Then, the nip portion N is formed in a state where the fixing belt 61 is held between the pressure roll 62 and the pressing pad 63. Then, while the sheet P holding an unfixed toner image is caused to pass through this nip portion N, heat and pressure are applied to the sheet P, and thereby, the unfixed toner image is fixed onto the sheet P.

The pressure roll 62 is formed of a multi-layer configuration including: a solid aluminum core (cylindrical core metal) 621 having a diameter of 18 mm, for example; a heat-resistant elastic layer 622 that covers the outer circumferential surface of the core 621, and that is made of silicone sponge having a thickness of 5 mm, for example; and a release layer 623 that is formed of a heat-resistant resin such as PFA containing carbon or the like, or a heat-resistant rubber, having a thickness of 50 μm, for example, and that covers the heat-resistant elastic layer 622. Then, the pressing pad 63 is pressed under a load of 245.166 N (25 kgf) for example, by pressing springs 68 (refer to FIG. 2) with the fixing belt 61 therebetween.

<Description of IH Heater>

Next, a description will be given of the IH heater 80 that induces the heat generation of the fixing belt 61 by electromagnetic induction by action of an AC magnetic field in the conductive heat-generating layer 612 of the fixing belt 61.

Figure 6:
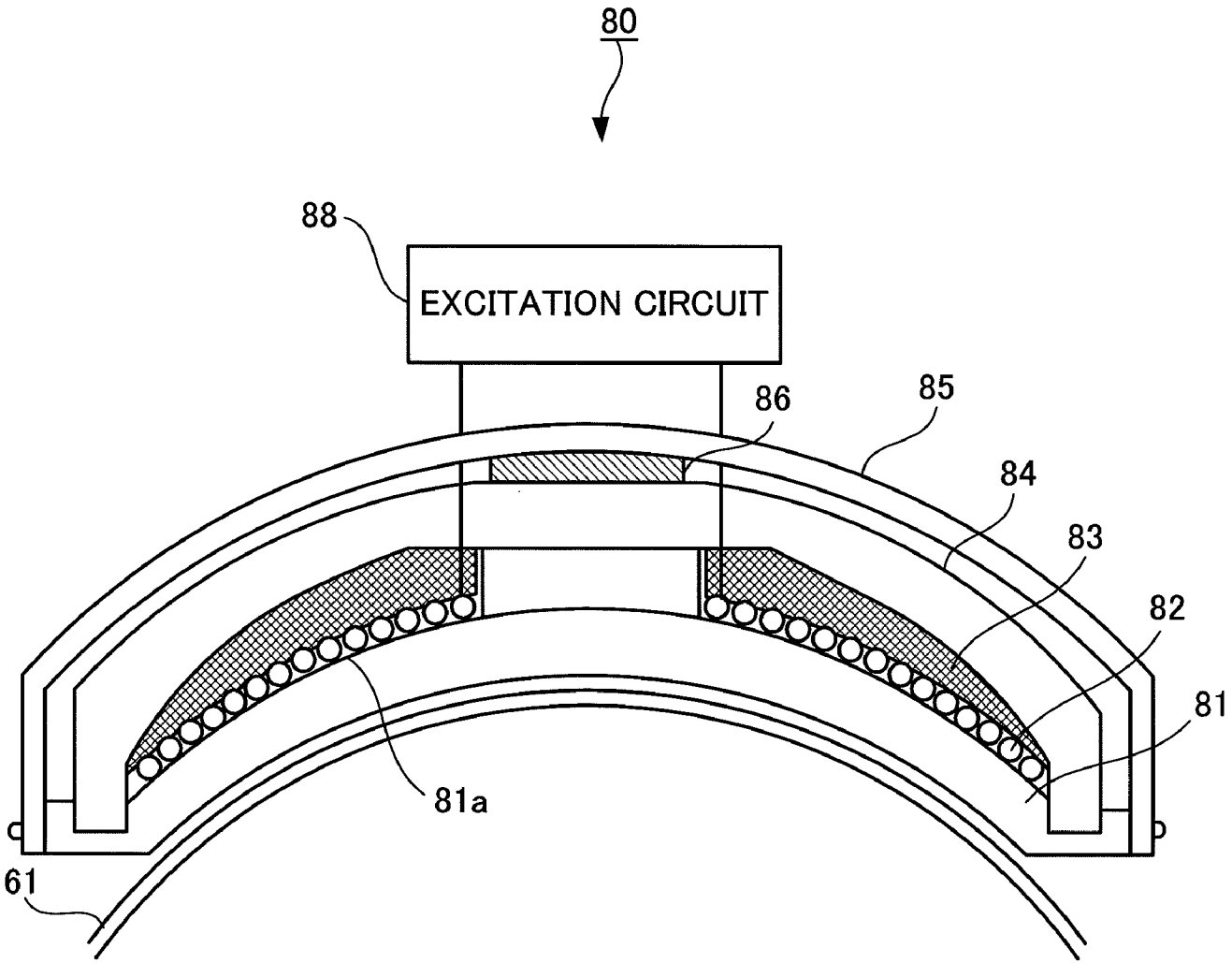
FIG. 6 is a cross sectional view for explaining a configuration of the IH heater.

FIG. 6 is a cross sectional view for explaining a configuration of the IH heater 80 of the exemplary embodiments. As shown in FIG. 6, the IH heater 80 includes: a support member 81 that is formed of a non-magnetic material such as a heat-resistant resin, for example; and the excitation coil 82 that generates the AC magnetic field. Moreover, the IH heater 80 includes: elastic support members 83 each of which is formed of an elastic material and secures the excitation coil 82 onto the support member 81; and a magnetic core 84 that forms a magnetic path of the AC magnetic field generated by the excitation coil 82. Further, the IH heater 80 includes: a shield 85 that shields a magnetic field; a pressing member 86 that presses the magnetic cores 84 toward the support member 81; and an excitation circuit 88 that supplies an AC current to the excitation coil 82.

The support member 81 is formed to have a cross section in a shape curving along the surface shape of the fixing belt 61, and includes an upper surface (supporting surface) 81*a* that supports the excitation coil 82 and that is formed so as to keep a gap set in advance (for example, 0.5 to 2 mm) with a surface of the fixing belt 61. As a material of the support member 81, a non-magnetic material having heat resistance is used, such as heat-resistant glass; heat-resistant resin such as polycarbonate, polyether sulphone and polyphenylene sulfide (PPS); and the aforementioned heat-resistant resin mixed with glass fibers.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

As the material of the magnetic core 84, a ferromagnetic material that is formed of an oxide or alloy material with a high permeability, such as a soft ferrite, a ferrite resin, a non-crystalline alloy (amorphous alloy), permalloys or a magnetic compensator alloys flux is used. The magnetic core 84 functions as a magnetic path unit. The magnetic core 84 induces, to the inside thereof, the magnetic field lines (magnetic flux) of the AC magnetic field generated at the excitation coil 82, and forms a path (magnetic path) of the magnetic field lines in which the magnetic field lines from the magnetic core 84 run across the fixing belt 61 to be directed to the temperature-sensitive magnetic member 64, then pass through the inside of the temperature-sensitive magnetic member 64, and return to the magnetic core 84. Specifically, a configuration in which the AC magnetic field generated at the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coil 82 is formed. Thereby, the magnetic field lines of the AC magnetic field generated at the excitation coil 82 are concentrated at a region of the fixing belt 61, which faces the magnetic core 84.

Here, the material of the magnetic core 84 may be one that has a small amount of loss due to the forming of the magnetic path. Specifically, the magnetic core 84 may be particularly used in a form that reduces the amount of eddy-current loss (shielding or controlling of the electric current path by having a slit or the like, or bundling of thin plates, or the like). In addition, the magnetic core 84 may be particularly formed of a material having a small hysteresis loss.

The length of the magnetic core 84 along the rotational direction of the fixing belt 61 is formed so as to be shorter than the length of the temperature-sensitive magnetic member 64 along the rotational direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit 60 is also suppressed and the heat-generating efficiency at the fixing belt 61 (conductive heat-generating layer 612) increases.

<Description of Securing Method of Excitation Coil>

Next, a description will be given of the securing method of the excitation coil 82 to the support member 81 in the IH heater 80 of the exemplary embodiments.

In the IH heater 80 of the exemplary embodiments, the elastic support member 83 as an example of an elastic support member that supports the excitation coil 82 to the support member 81 is formed of an elastic material such as silicone rubber or fluorine-contained rubber. The elastic support member 83 elastically deforms while pressing the excitation coil 82 toward the support member 81, and thereby supporting the excitation coil 82 to the supporting surface of the support member 81. In other words, the elastic support member 83 is made of a material having a low Young's modulus, elastically deforms when the elastic support member 83 having the low Young's modulus presses the excitation coil 82 toward the support member 81, and then supports the excitation coil 82 to the support member 81.

Figure 7:
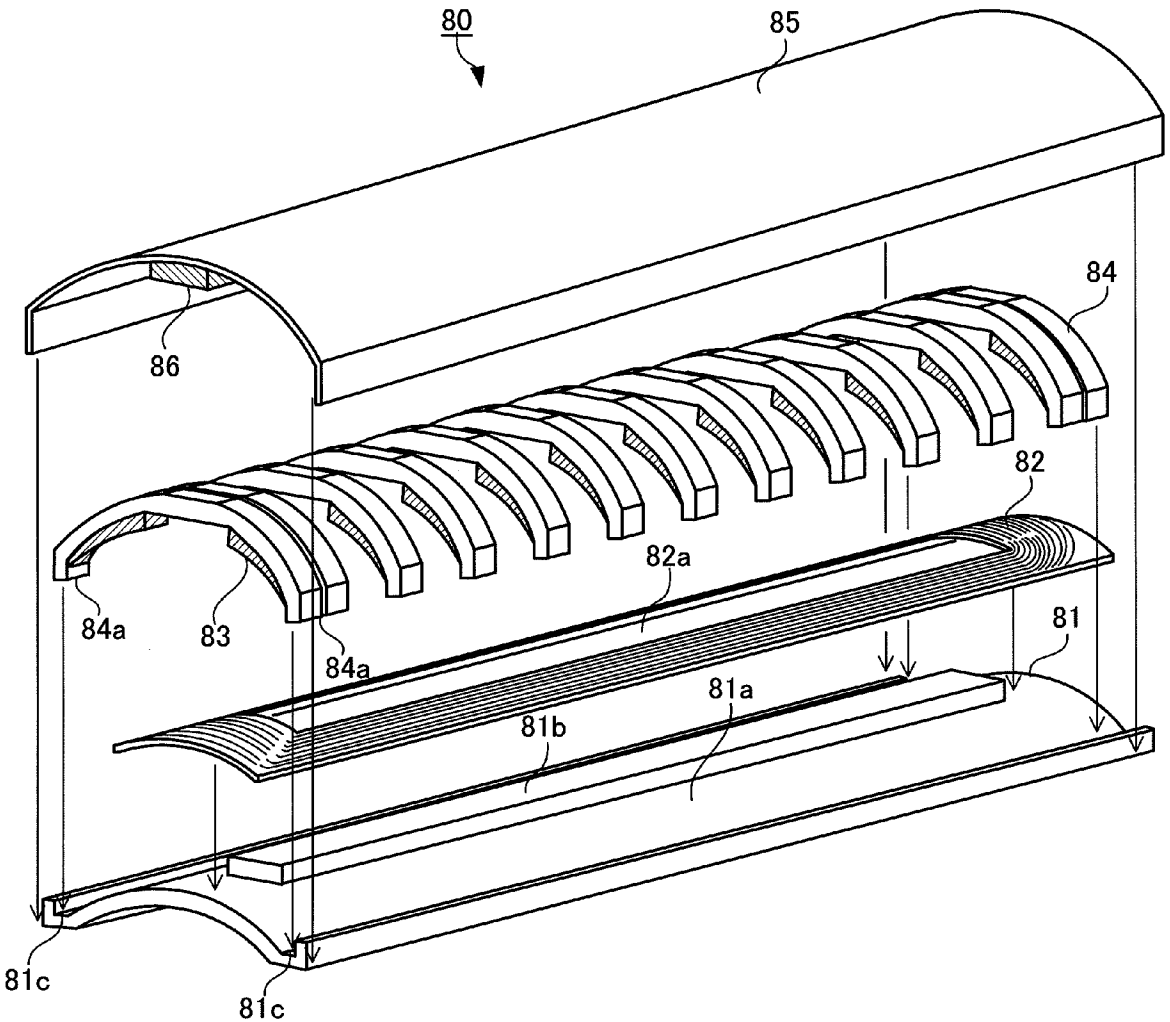
FIG. 7 is a diagram for explaining a multi-layer structure of the IH heater.

FIG. 7 is a diagram for explaining a multi-layer structure of the IH heater 80 in the exemplary embodiments. As shown in FIG. 7, the excitation coil 82 is arranged on the supporting surface 81*a* of the support member 81 so that a closed loop hollow 82*a* of the excitation coil 82 may surround a convex portion 81*b* arranged in the center axis in the longitudinal direction of the supporting surface 81*a*. The supporting surface 81*a* is formed as a position setting surface whose gap with the fixing belt 61 that is supported by the above-described end caps 67 (refer to FIG. 5) and that rotationally moves in a substantially circular orbit is set at a defined value (design value). The excitation coil 82 is arranged so as to be in close contact with the supporting surface 81*a*, and thereby the gap between the excitation coil 82 and the fixing belt 61 is set at the designed value.

By this setting, in the IH heater 80 of the exemplary embodiments, the excitation coil 82 arranged on the supporting surface 81*a* of the support member 81 is pressed toward the supporting surface 81*a* by the elastic support members 83. In other words, the magnetic cores 84 arranged above the excitation coil 82 each have both ends 84*a* attached to supporting rails 81*c* provided at the both ends of the support member 81 (also refer to FIG. 6). Thereby, the elastic support members 83 arranged at the lower side faces of the magnetic cores 84 (side faces on the support member 81 side) are arranged so as to be in contact with the upper surface of the excitation coil 82. On the other hand, the magnetic cores 84 are pressed toward the support member 81 by the pressing member 86 provided on the lower surface of the shield 85 when the shield 85 is attached to the support member 81. Thereby, the excitation coil 82 receives elastic force from the elastic support members 83 which have received pressing force from the magnetic cores 84, and the excitation coil 82 is supported on the supporting surface 81*a* while being pressed toward the supporting surface 81*a* by the elastic support members 83 elastically deformed by the pressing force. Accordingly, the excitation coil 82 is in close contact with the supporting surface 81*a* and the gap between the excitation coil 82 and the fixing belt 61 is set at the designed value.

Note that, as the pressing member 86, an elastic member such as a spring may be used instead of an elastic material such as a silicone rubber or fluorine-contained rubber.

In general, when an AC magnetic field is generated by the excitation coil 82, magnetic force acts between the magnetic cores 84 arranged in the vicinity of the excitation coil 82, the temperature-sensitive magnetic member 64 arranged on the inner circumferential surface side of the fixing belt 61 and the like, and thereby the excitation coil 82 vibrates itself (exhibits a magnetostrictive property). Thereby, if the excitation coil 82 is secured to the support member 81 by using a so-called rigid body (material having a high Young's modulus) such as an adhesive agent, peeling easily occurs between the excitation coil 82 and the rigid body such as the adhesive agent due to the vibration of the excitation coil 82 during the accumulated use of the fixing unit 60 for a long period. Then, when the excitation coil 82 is peeled from the rigid body such as the adhesive agent, the excitation coil 82 is displaced on the supporting surface 81*a*, or the excitation coil 82 deforms. Thereby, the gap between the excitation coil 82 and the fixing belt 61 is deviated from the originally designed value, and the density of the magnetic field lines (density of magnetic flux) passing through the fixing belt 61 via the magnetic cores 84 partially varies on the surface of the fixing belt 61. For this reason, the amount of the eddy current I generated at the fixing belt 61 becomes uneven, and the amount of heat generation on the surface of the fixing belt 61 may partially vary in some cases.

When the excitation coil 82 is secured to the support member 81 by use of a rigid body such as an adhesive agent, whole surfaces of the excitation coil 82 are necessary to be immobilized so as not to be displaced from the support member 81 until the adhesive agent or the like sets. The excitation coil 82, however, has a configuration in which litz wires are bundled in a closed loop shape and are adhered to each other, for example. Thus, the excitation coil 82 is easily deformed.

Accordingly, it is difficult to immobilize the excitation coil 82 so that the excitation coil 82 is not displaced from the support member 81, until the adhesive agent or the like sets, and thus a positional accuracy of the excitation coil 82 with respect to the support member 81 is likely to be lowered. If the positional accuracy of the excitation coil 82 with respect to the support member 81 is lowered, a condition in which the heat generating amount of the surface of the fixing belt 61 partially varies is formed, similarly to the above.

In the IH heater 80 of the exemplary embodiments, the elastic support members 83 formed of an elastic material such as silicone rubber, fluorine-contained rubber or the like press the excitation coil 82 toward the support member 81, and thereby a configuration in which the excitation coil 82 is supported by the supporting surface 81*a* of the support member 81 is achieved. The elastic support members 83 formed of an elastic material elastically deform in response to the vibration of the excitation coil 82 while absorbing the vibration of the excitation coil 82. Thereby, even if the accumulated number of vibrations of the excitation coil 82 is large due to the accumulated use of the fixing unit 60 for a long period, the elastic support members 83 and the excitation coil 82 are not peeled from each other, and the positional relationship between the support member 81 and the excitation coil 82 is maintained to be a default setting one.

Moreover, the elastic support member 83 is controlled so as to have the thickness (setting value) within the dimensional precision set in advance at the production. Therefore, pressing force for supporting the excitation coil 82 on the supporting surface 81*a* in the longitudinal direction is set to be approximately uniform. In particular, in the IH heater 80 of the exemplary embodiments, the multiple excitation cores 84 uniformly press the excitation coil 82 in the longitudinal direction. Here, the multiple excitation cores 84 are separately provided in the longitudinal direction of the excitation coil 82. Thereby, closeness between the excitation coil 82 and the supporting surface 81*a* is increased in the longitudinal direction, and the positions of the excitation coil 82 and the fixing belt 61 are set in the longitudinal direction.

At the production of the IH heater 80, the excitation coil 82 is attached in a short time without time until the adhesive agent or the like sets.

<Description of a State in which Fixing Belt Generates Heat>

Next, a description will be given of a state in which the fixing belt 61 generates heat by use of the AC magnetic field generated by the IH heater 80.

Firstly, as described above, the permeability change start temperature of the temperature-sensitive magnetic member 64 is set within a temperature range (140 to 240 degrees C., for example) where the temperature is not less than the fixation setting temperature for fixing color toner images and not greater than the heat-resistant temperature of the fixing belt 61. Then, when the temperature of the fixing belt 61 is not greater than the permeability change start temperature, the temperature of the temperature-sensitive magnetic member 64 near the fixing belt 61 corresponds to the temperature of the fixing belt 61 and then becomes equal to or lower than the permeability change start temperature. For this reason, the temperature-sensitive magnetic member 64 has a ferromagnetic property at this time, and thus, the magnetic field lines H of the AC magnetic field generated by the IH heater 80 form a magnetic path where the magnetic field lines H go through the fixing belt 61 and thereafter, pass through the inside of the temperature-sensitive magnetic member 64 along a spreading direction. Here, the "spreading direction" refers to a direction orthogonal to the thickness direction of the temperature-sensitive magnetic member 64.

Figure 8:
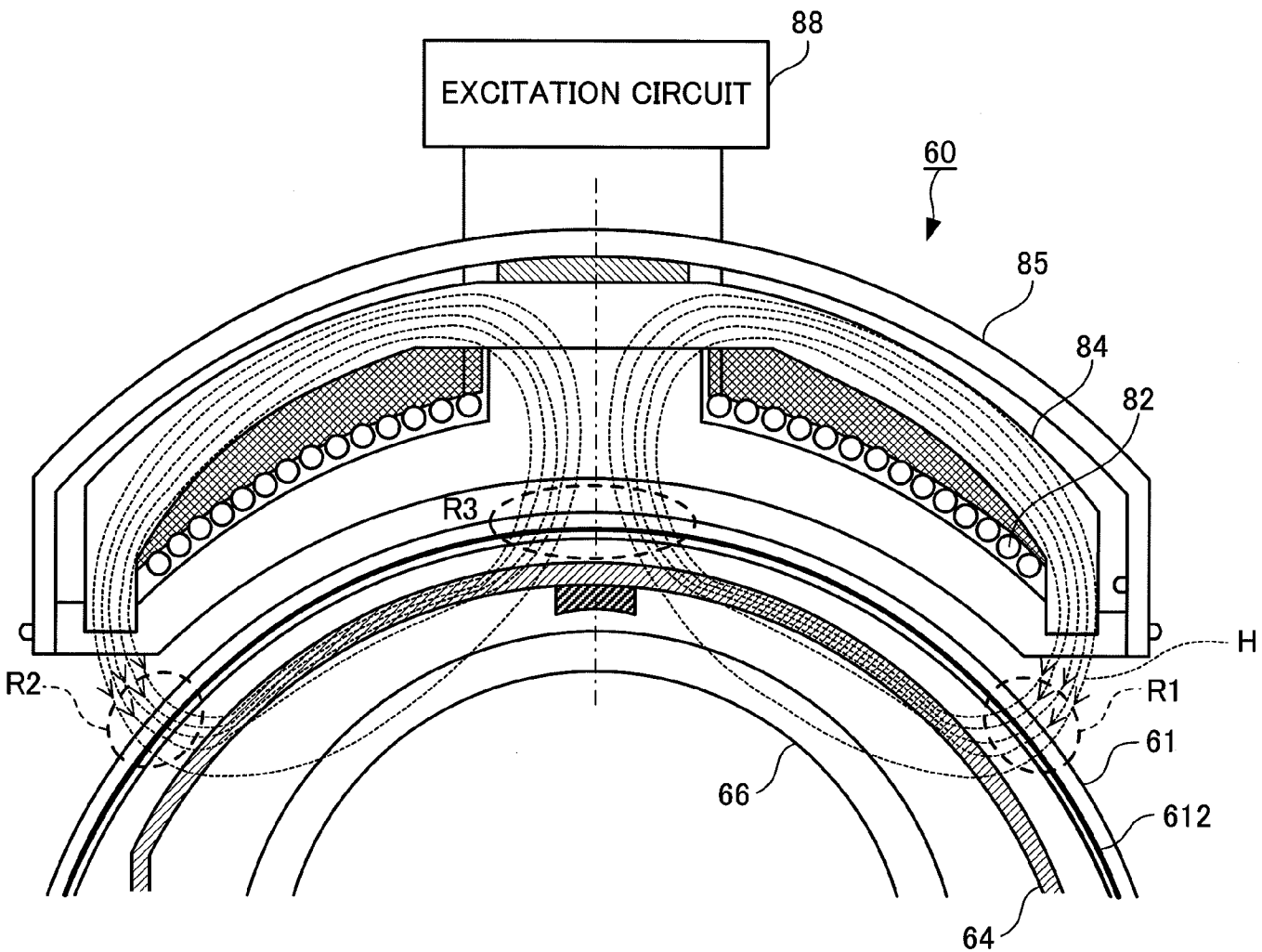
FIG. 8 is a diagram for explaining the state of the magnetic field lines in a case where the temperature of the fixing belt is within the temperature range not greater than the permeability change start temperature.

FIG. 8 is a diagram for explaining the state of the magnetic field lines H in a case where the temperature of the fixing belt 61 is within the temperature range not greater than the permeability change start temperature. As shown in FIG. 8, in the case where the temperature of the fixing belt 61 is within the temperature range not greater than the permeability change start temperature, the magnetic field lines H of the AC magnetic field generated by the IH heater 80 form a magnetic path where the magnetic field lines H go through the fixing belt 61, and then pass through the inside of the temperature-sensitive magnetic member 64 in the spreading direction (direction orthogonal to the thickness direction). Accordingly, the number of the magnetic field lines H (density of magnetic flux) per unit area in the region where the magnetic field lines H run across the conductive heat-generating layer 612 of the fixing belt 61 becomes large.

Specifically, after the magnetic field lines H are radiated from the magnetic cores 84 of the IH heater 80 and pass through regions R1 and R2 where the magnetic field lines H run across the conductive heat-generating layer 612 of the fixing belt 61, the magnetic field lines H are induced to the inside of the temperature-sensitive magnetic member 64, which is a ferromagnetic member. For this reason, the magnetic field lines H running across the conductive heat-generating layer 612 of the fixing belt 61 in the thickness direction are concentrated so as to enter the inside of the temperature-sensitive magnetic member 64. Accordingly, the magnetic flux density becomes high in the regions R1 and R2. In addition, in a case where the magnetic field lines H passing through the inside of the temperature-sensitive magnetic member 64 along the spreading direction return to the magnetic core 84, in a region R3 where the magnetic field lines H run across the conductive heat-generating layer 612 in the thickness direction, the magnetic field lines H are generated toward the magnetic core 84 in a concentrated manner from a portion, where the magnetic potential is low, of the temperature-sensitive magnetic member 64. For this reason, the magnetic field lines H running across the conductive heat-generating layer 612 of the fixing belt 61 in the thickness direction head from the temperature-sensitive magnetic member 64 toward the magnetic core 84 in a concentrated manner, so that the magnetic flux density in the region R3 becomes high as well.

In the conductive heat-generating layer 612 of the fixing belt 61 which the magnetic field lines H run across in the thickness direction, the eddy current I proportional to the amount of change in the number of the magnetic field lines H per unit area (magnetic flux density) is generated. Thereby, as shown in FIG. 8, a larger eddy current I is generated in the regions R1, R2 and R3 where a large amount of change in the magnetic flux density occurs. The eddy current I generated in the conductive heat-generating layer 612 generates a Joule heat W ($W=I^2R$), which is multiplication of the specific resistant value R and the square of the eddy current I of the conductive heat-generating layer 612. Accordingly, a large Joule heat W is generated in the conductive heat-generating layer 612 where the larger eddy current I is generated.

As described above, in a case where the temperature of the fixing belt 61 is within the temperature range not greater than the permeability change start temperature, a large amount of heat is generated in the regions R1, R2 and R3 where the magnetic field lines H run across the conductive heat-generating layer 612, and thereby the fixing belt 61 is heated. Incidentally, in the fixing unit 60 of the exemplary embodiments, the temperature-sensitive magnetic member 64 is arranged so as to be close to the inner circumferential surface of the fixing belt 61, thereby, providing the configuration in which the magnetic cores 84 inducing the magnetic field lines H generated at the excitation coil 82 to the inside thereof, and the temperature-sensitive magnetic member 64 inducing, to the inside thereof, the magnetic field lines H running across and going through the fixing belt 61 in the thickness direction are arranged to be close to each other. For this reason, the AC magnetic field generated by the IH heater 80 (excitation coil 82) forms a loop of a short magnetic path, so that the magnetic flux density and the degree of magnetic coupling in the magnetic path increase. Thereby, heat is more efficiently generated in the fixing belt 61 in a case where the temperature of the fixing belt 61 is within the temperature range not greater than the permeability change start temperature.

<Description of Function for Suppressing Increase in Temperature of Non-Sheet Passing Portion of Fixing Belt>

Next, a description will be given of a function for suppressing an increase in the temperature of a non-sheet passing portion of the fixing belt 61.

Figure 9:
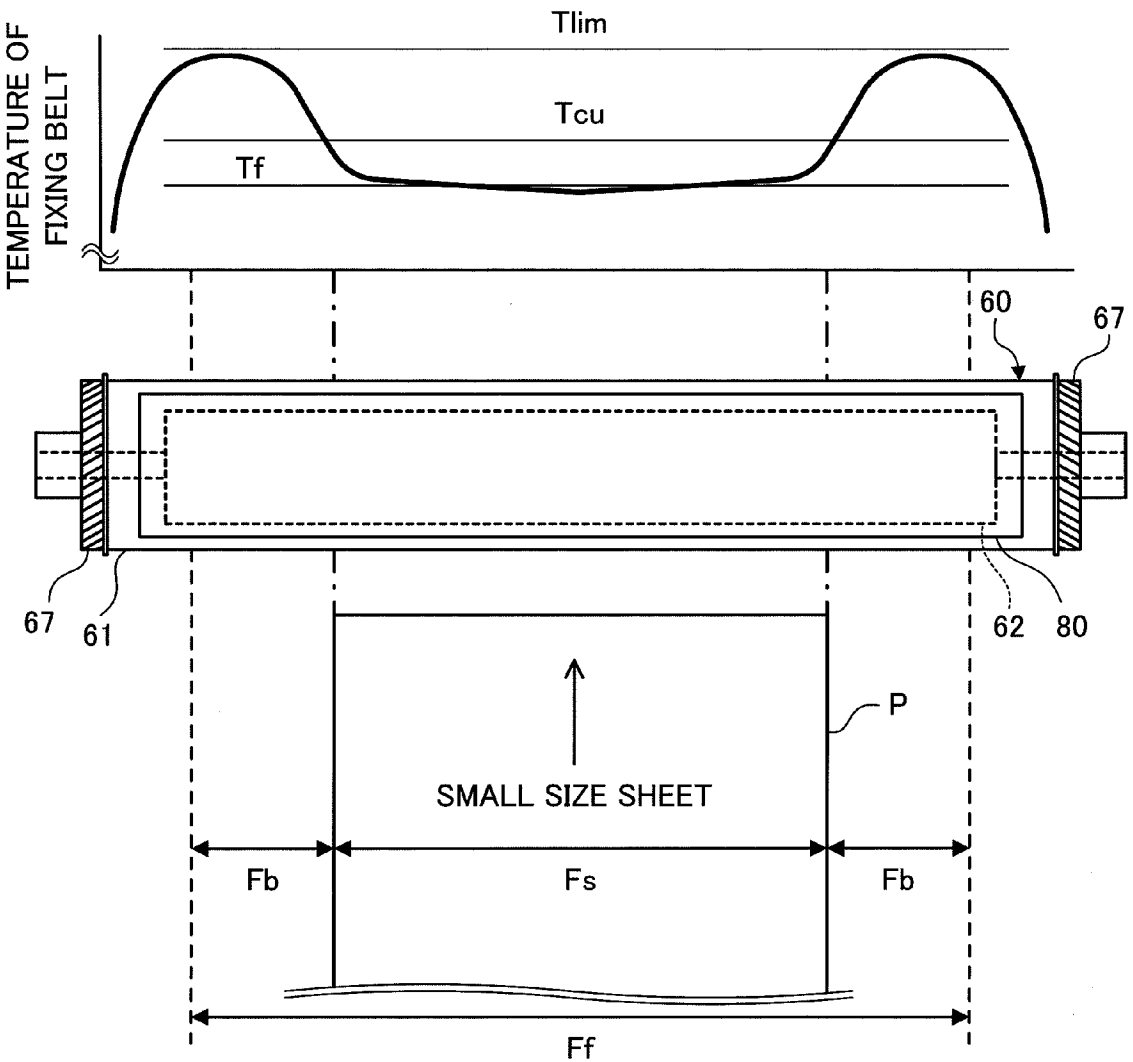
FIG. 9 is a diagram showing a summary of a temperature distribution in the width direction of the fixing belt when the small size sheets are successively inserted into the fixing unit.

Firstly, a description will be given herein of a case where sheets P of a small size (small size sheets P1) are successively inserted into the fixing unit 60. FIG. 9 is a diagram showing a summary of a temperature distribution in the width direction of the fixing belt 61 when the small size sheets P1 are successively inserted into the fixing unit 60. In FIG. 9, Ff denotes a maximum sheet passing region, which is the width (A3 long side, for example) of the maximum size of a sheet P used in the image forming apparatus 1, Fs denotes a region through which the small size sheet P1 (A4 longitudinal feed, for example) having a smaller horizontal width than that of a maximum size sheet P passes, and Fb denotes a non-sheet passing region through which no small size sheet P1 passes. Note that, sheets are inserted into the image forming apparatus 1 with the center position thereof as the reference point.

As shown in FIG. 9, when the small size sheets P1 are successively inserted into the fixing unit 60, the heat for fixing is consumed at the small size sheet passing region Fs where each of the small size sheets P1 passes. For this reason, the controller 31 (refer to FIG. 1) performs a temperature adjustment control with a fixation setting temperature, so that the temperature of the fixing belt 61 at the small size sheet passing region Fs is maintained within a range near the fixation setting temperature. Meanwhile, at the non-sheet passing regions Fb as well, the same temperature adjustment control as that performed for the small size sheet passing region Fs is performed. However, the heat for fixing is not consumed at the non-sheet passing regions Fb. For this reason, the temperature of the non-sheet passing regions Fb easily increases to a temperature higher than the fixation setting temperature. Then, when the small size sheets P1 are successively inserted into the fixing unit 60 in this state, the temperature of the non-sheet passing regions Fb increases to a temperature higher than the heat-resistant temperature of, for example, the elastic layer 613 or the surface release layer 614 of the fixing belt 61, hence deteriorating the fixing belt 61 in some cases.

In this respect, as described above, in the fixing unit 60 of the exemplary embodiments, the temperature-sensitive magnetic member 64 is formed of, for example, a Fe—Ni alloy or the like whose permeability change start temperature is set within a temperature range not less than the fixation setting temperature and not greater than the heat-resistant temperature of the elastic layer 613 or the surface release layer 614 of the fixing belt 61. Specifically, as shown in FIG. 9, a permeability change start temperature Tcu of the temperature-sensitive magnetic member 64 is set within a temperature range not less than a fixation setting temperature Tf and not greater than a heat-resistant temperature Tlim of, for example, the elastic layer 613 or the surface release layer 614.

Thus, when the small size sheets P1 are successively inserted into the fixing unit 60, the temperature of the non-sheet passing regions Fb of the fixing belt 61 exceeds the permeability change start temperature of the temperature-sensitive magnetic member 64. Accordingly, the temperature of the temperature-sensitive magnetic member 64 near the fixing belt 61 at the non-sheet passing regions Fb also exceeds the permeability change start temperature in response to the temperature of the fixing belt 61 as in the case of the fixing belt 61. For this reason, the relative permeability of the temperature-sensitive magnetic member 64 at the non-sheet passing regions Fb becomes close to 1, so that the temperature-sensitive magnetic member 64 at the non-sheet passing regions Fb loses the ferromagnetic properties. Since the relative permeability of the temperature-sensitive magnetic member 64 decreases and becomes closer to 1, the magnetic field lines H at the non-sheet passing regions Fb are no longer induced to the inside of the temperature-sensitive magnetic member 64, and start going through the temperature-sensitive magnetic member 64. For this reason, in the fixing belt 61 at the non-sheet passing regions Fb, the magnetic field lines H spread after passing through the conductive heat-generating layer 612, hence leading to a decrease in the density of magnetic flux of the magnetic field lines H running across the conductive heat-generating layer 612. Thereby, the amount of an eddy current I generated at the conductive heat-generating layer 612 decreases, and then, the amount of heat (Joule heat W) generated at the fixing belt 61 decreases. As a result, an excessive increase in the temperature at the non-sheet passing regions Fb is suppressed, and the fixing belt 61 is prevented from being damaged.

As described above, the temperature-sensitive magnetic member 64 functions as a detector that detects the temperature of the fixing belt 61 and also functions as a temperature increase suppresser that suppresses an excessive increase in the temperature of the fixing belt 61 in accordance with the detected temperature of the fixing belt 61, at a time.

The magnetic field lines H passing through the temperature-sensitive magnetic member 64 arrive at the induction member 66 (refer to FIG. 3) and then are induced to the inside thereof. When the magnetic flux arrives at the induction member 66 and then is induced to the inside thereof, a large amount of the eddy current I flows into the induction member 66, into which the eddy current I flows more easily than into the heat conducive layer 612. Thus, the amount of eddy current flowing into the conductive layer 612 is further suppressed, so that an increase in the temperature at the non-sheet passing regions Fb is suppressed.

At this time, the thickness, material and shape of the induction member 66 are selected in order that the induction member 66 may induce most of the magnetic field lines H from the excitation coil 82 and the magnetic field lines H may be prevented from leaking from the fixing unit 60. Specifically, the induction member 66 is formed of a material having a sufficiently large thickness of the skin depth δ. Thereby, even when the eddy current I flows into the induction member 66, the amount of heat to be generated is extremely small. In the exemplary embodiments, the induction member 66 is formed of Al (aluminum), with a thickness of 1 mm, of a substantially circular arc shape along the temperature-sensitive magnetic member 64. The induction member 66 is also arranged so as not to be in contact with the temperature-sensitive magnetic member 64 (average distance therebetween is 4 mm, for example). As another example of the material, Ag or Cu may be particularly used.

Incidentally, when the temperature of the fixing belt 61 at the non-sheet passing regions Fb becomes lower than the permeability change start temperature of the temperature-sensitive magnetic member 64, the temperature of the temperature-sensitive magnetic member 64 at the non-sheet passing regions Fb also becomes lower than the permeability change start temperature thereof. For this reason, the temperature-sensitive magnetic member 64 becomes ferromagnetic again, and the magnetic field lines H are induced to the inside of the temperature-sensitive magnetic member 64. Thus, a large amount of the eddy current I flows into the conductive heat-generating layer 612. For this reason, the fixing belt 61 is again heated.

Figure 10:
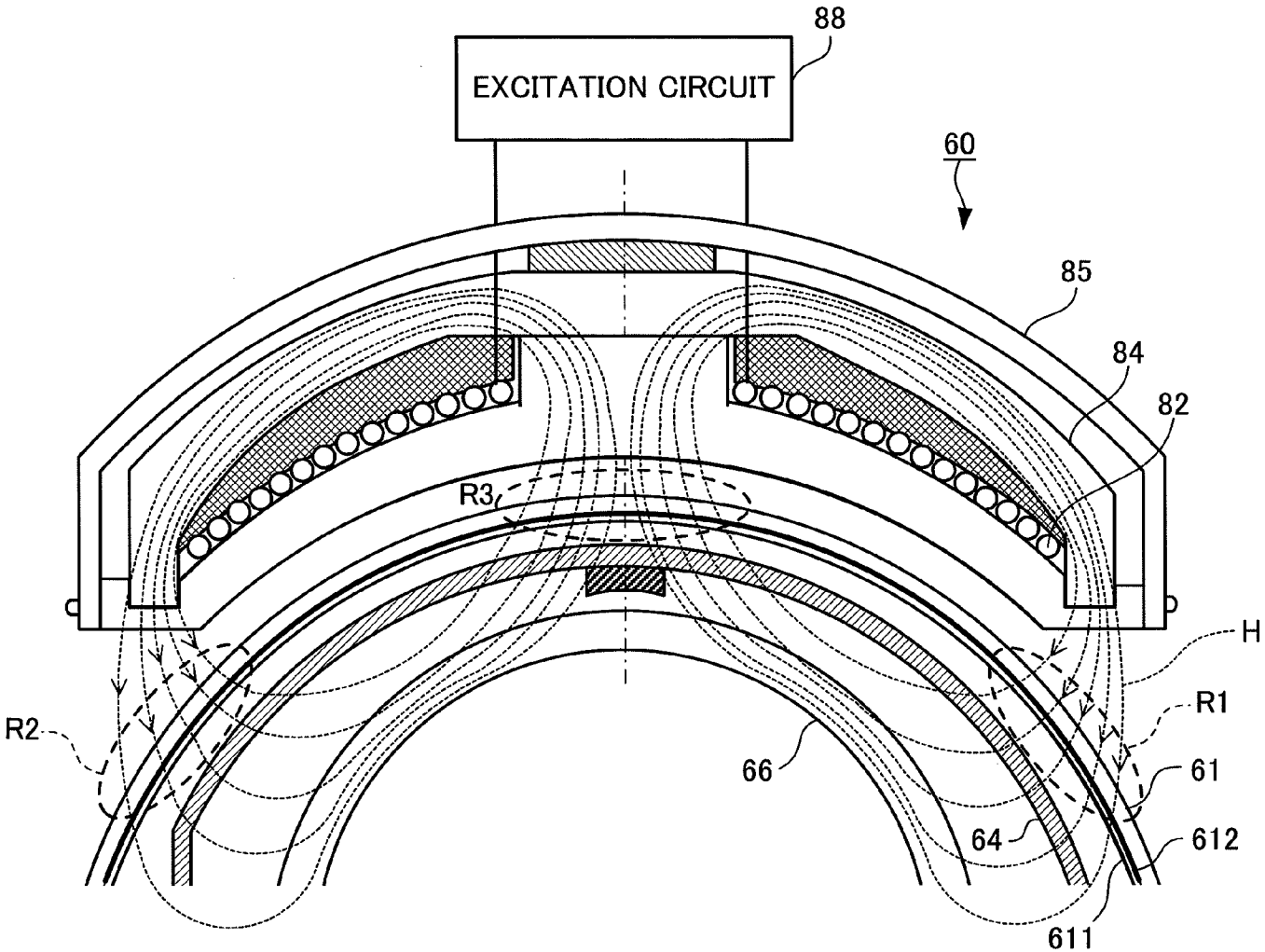
FIG. 10 is a diagram for explaining a state of the magnetic field lines when the temperature of the fixing belt at the non-sheet passing regions is within the temperature range exceeding the permeability change start temperature.

FIG. 10 is a diagram for explaining a state of the magnetic field lines H when the temperature of the fixing belt 61 at the non-sheet passing regions Fb is within the temperature range exceeding the permeability change start temperature. As shown in FIG. 10, when the temperature of the fixing belt 61 at the non-sheet passing regions Fb is within the temperature range exceeding the permeability change start temperature, the relative permeability of the temperature-sensitive magnetic member 64 at the non-sheet passing regions Fb decreases. For this reason, the magnetic field lines H of the AC magnetic field generated by the IH heater 80 changes so as to easily go through the temperature-sensitive magnetic member 64. Thereby, the magnetic field lines H of the AC magnetic field generated by the IH heater 80 (excitation coil 82) are radiated from the magnetic cores 84 so as to spread toward the fixing belt 61 and arrive at the induction member 66.

Specifically, at the regions R1 and R2 where the magnetic field lines H are radiated from the magnetic cores 84 of the IH heater 80 and then run across the conductive heat-generating layer 612 of the fixing belt 61, since the magnetic field lines H are not easily induced to the temperature-sensitive magnetic member 64, the magnetic field lines H radially spread. Accordingly, the density of the magnetic flux (the number of the magnetic field lines H per unit area) of the magnetic field lines H running across the conductive heat-generating layer 612 of the fixing belt 61 in the thickness direction decreases. In addition, at the region R3 where the magnetic field lines H run across the conductive heat-generating layer 612 in the thickness direction when returning to the magnetic cores 84 again, the magnetic field lines H return to the magnetic cores 84 from the wide region where the magnetic field lines H spread, so that the density of the magnetic flux of the magnetic field lines H running across the conductive heat-generating layer 612 of the fixing belt 61 in the thickness direction decreases.

For this reason, when the temperature of the fixing belt 61 is within the temperature range exceeding the permeability change start temperature, the density of the magnetic flux of the magnetic field lines H running across the conductive heat-generating layer 612 in the thickness direction at the regions R1, R2 and R3 decreases. Accordingly, the amount of the eddy current I generated in the conductive heat-generating layer 612 where the magnetic field lines H run across in the thickness direction decreases, and the Joule heat W generated at the fixing belt 61 decreases. Therefore, the temperature of the fixing belt 61 decreases.

As described above, when the temperature of the fixing belt 61 at the non-sheet passing regions Fb is within a temperature range not less than the permeability change start temperature, the magnetic field lines H are not easily induced to the inside of the temperature-sensitive magnetic member 64 at the non-sheet passing regions Fb. Thus, the magnetic field lines H of the AC magnetic field generated by the excitation coil 82 spread and run across the conductive heat-generating layer 612 of the fixing belt 61 in the thickness direction. Accordingly, the magnetic path of the AC magnetic field generated by the excitation coil 82 forms a long loop, so that the density of magnetic flux in the magnetic path in which the magnetic field lines H pass through the conductive heat-generating layer 612 of the fixing belt 61 decreases.

Thereby, at the non-sheet passing regions Fb where the temperature thereof increases, for example, when the small size sheets P1 are successively inserted into the fixing unit 60, the amount of the eddy current I generated at the conductive heat-generating layer 612 of the fixing belt 61 decreases, and the amount of heat (Joule heat W) generated at the non-sheet passing regions Fb of the fixing belt 61 decreases. As a result, an excessive increase in the temperature of the non-sheet passing regions Fb is suppressed.

<Description of Configuration for Suppressing Increase in Temperature of Temperature-Sensitive Magnetic Member>

In order for the temperature-sensitive magnetic member 64 to satisfy the aforementioned function to suppress an excessive increase in the temperature at the non-sheet passing regions Fb, the temperature of each region of the temperature-sensitive magnetic member 64 in the longitudinal direction needs to change in accordance with the temperature of each region of the fixing belt 61 in the longitudinal direction, which faces each region of the temperature-sensitive magnetic member 64 in the longitudinal direction, to satisfy the aforementioned function as a detector that detects the temperature of the fixing belt 61.

For this reason, as the configuration of the temperature-sensitive magnetic member 64, a configuration in which the temperature-sensitive magnetic member 64 is not easily subjected to induction heating by the magnetic field lines H is employed. Specifically, even when the temperature-sensitive magnetic member 64 is in a state of being ferromagnetic since the temperature of the fixing belt 61 is not greater than the permeability change start temperature, some of the magnetic field lines H that run across the temperature-sensitive magnetic member 64 in the thickness direction still exist in the magnetic field lines H from the IH heater 80. Thus, a weak eddy current I is generated inside the temperature-sensitive magnetic member 64, so that a small amount of heat is generated in the temperature-sensitive magnetic member 64 as well. For this reason, for example, in a case where a large amount of image formation is successively performed, the heat generated by the temperature-sensitive magnetic member 64 is accumulated in itself, and the temperature of the temperature-sensitive magnetic member 64 at the sheet passing region (refer to FIG. 9) tends to increase. When the amount of the self-heating due to the eddy current loss in this manner is large, the temperature of the temperature-sensitive magnetic member 64 increases, and unintentionally reaches the permeability change start temperature. As a result, the magnetic characteristic difference between the sheet-passing region and the non-sheet passing regions no longer exists, and thus, the effect of suppressing a temperature increase becomes no longer effective. In this respect, in order to maintain the correspondence relationship between the respective temperatures of the temperature-sensitive magnetic member 64 and the fixing belt 61 and in order for the temperature-sensitive magnetic member 64 to function as the detector that detects the temperature of the fixing belt 61 with high accuracy, Joule heat W to be generated in the temperature-sensitive magnetic member 64 needs to be suppressed.

With this respect, firstly, a material having properties (specific resistance and permeability) not easily subjected to induction heating by the magnetic field lines H is selected as the material of the temperature-sensitive magnetic member 64 for the purpose of reducing an eddy current loss or hysteresis loss in the temperature-sensitive magnetic member 64.

Secondly, the thickness of the temperature-sensitive magnetic member 64 is formed to be larger than the skin depth δ in the state where the temperature-sensitive magnetic member 64 is ferromagnetic, in order that the magnetic field lines H may not easily run across the temperature-sensitive magnetic member 64 in the thickness direction when the temperature of the temperature-sensitive magnetic member 64 is at least within the temperature range not greater than the permeability change start temperature.

Thirdly, multiple slits 64*s* (refer to FIG. 11 described later) controlling the flow of an eddy current I generated by the magnetic field lines H are formed in the temperature-sensitive magnetic member 64. Even when the material and the thickness of the temperature-sensitive magnetic member 64 are selected so as not to be easily subjected to induction heating, it is difficult to make the eddy current I generated inside the temperature-sensitive magnetic member 64 be zero (0). In this respect, the amount of eddy current I is decreased by controlling the flow of the eddy current I generated in the temperature-sensitive magnetic member 64 with the multiple slits 64*s*. Thereby, Joule heat W generated in the temperature-sensitive magnetic member 64 is suppressed to be low.

Figure 11A:
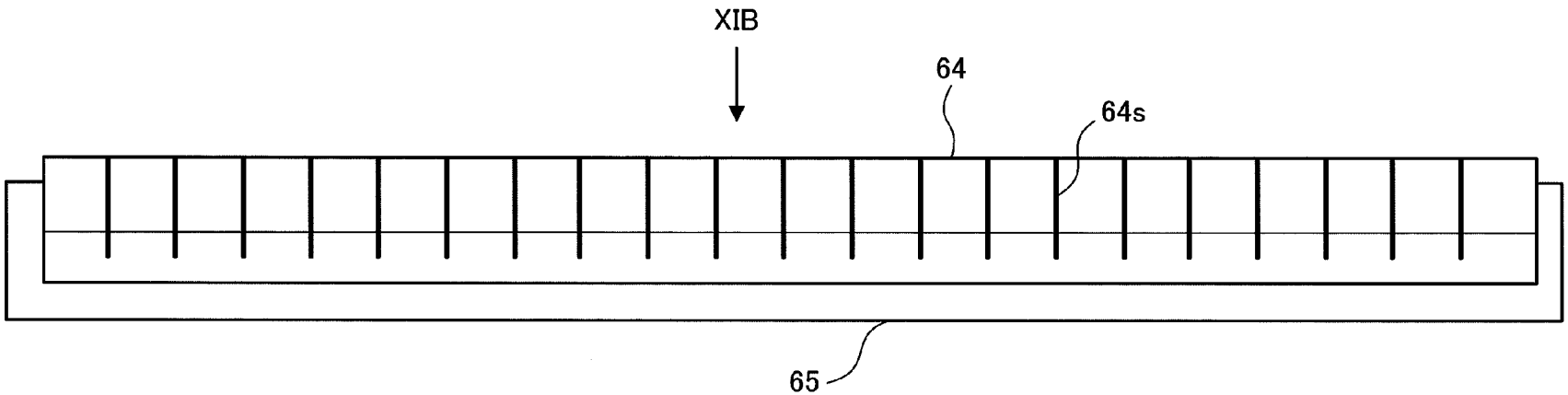
FIGS. 11A and 11B are diagrams showing slits formed in the temperature-sensitive magnetic member.
Figure 11B:
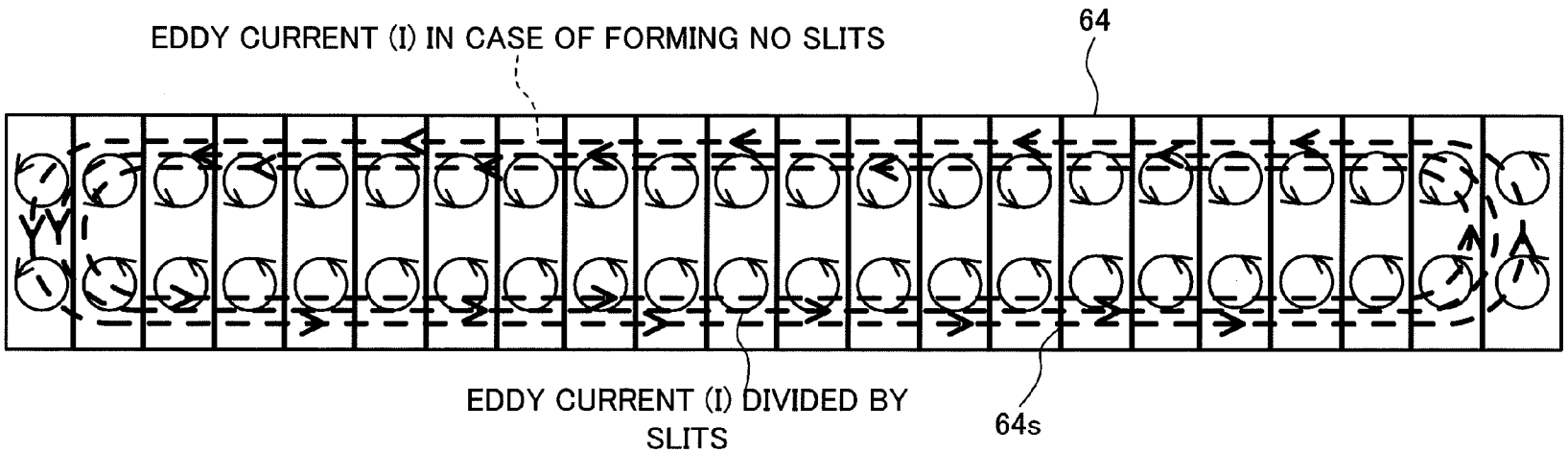

FIGS. 11A and 11B are diagrams showing slits formed in the temperature-sensitive magnetic member 64. FIG. 11A is a side view showing a state where the temperature-sensitive magnetic member 64 is mounted on the holder 65. FIG. 11B is a plain view showing a state when FIG. 11A is viewed from above (XIB direction). As shown in FIGS. 11A and 11B, the multiple slits 64*s* are formed in a direction orthogonal to the direction of the flow of the eddy current I generated by the magnetic field lines H, in the temperature-sensitive magnetic member 64. Thereby, the eddy current I (shown by broken lines in FIG. 11B), which flows in the entire temperature-sensitive magnetic member 64 in the longitudinal direction while forming a large swirl in a case of forming no slits 64*s*, is controlled by the slits 64*s*. Accordingly, in a case where the slits 64*s* are formed, the eddy current I (shown by a solid line in FIG. 11B) that flows in the temperature-sensitive magnetic member 64 becomes small swirls each being in a region formed between adjacent two of the slits 64*s*, hence reducing the entire amount of the eddy current I. As a result, the amount of heat (Joule heat W) generated in the temperature-sensitive magnetic member 64 decreases. Thereby, the configuration in which heat is not easily generated is achieved. Accordingly, each of the multiple slits 64*s* functions as an eddy current controlling unit that controls the eddy current I.

Note that, the slits 64*s* are formed in the direction orthogonal to the direction of the flow of the eddy current I in the temperature-sensitive magnetic member 64 exemplified in FIGS. 11A and 11B. However, as long as the configuration allows the slits 64*s* to control the flow of the eddy current I, slits inclined with respect to the direction of the flow of the eddy current I may be formed, for example. Moreover, other than the configuration as shown in FIGS. 11A and 11B in which the slits 64*s* are formed over the entire region in the width direction of the temperature-sensitive magnetic member 64, slits may be partially formed in the width direction of the temperature-sensitive magnetic member 64. Furthermore, the number of, the position of or the inclination angle of slits 64*s* may be configured in accordance with the amount of heat to be generated in the temperature-sensitive magnetic member 64.

In addition, the slits 64*s* may be formed in the temperature-sensitive magnetic member 64 in a way that the temperature-sensitive magnetic member 64 is divided into a group of small pieces by the slits 64*s* with an inclination angle of each slit Ms being the maximum. The effects of the present invention may be obtained in this configuration as well.

Fourthly, the temperature-sensitive magnetic member 64 is provided with a heat radiation path formed thereon. Here, the heat radiation path is an example of a heat transfer unit that radiates (transfers) heat generated in the temperature-sensitive magnetic member 64 in an inner direction of the temperature-sensitive magnetic member 64 (direction toward the induction member 66). In this case, it is desirable to maintain the temperature of the temperature-sensitive magnetic member 64 so that it is substantially the same as the temperature of the fixing belt 61, from a viewpoint of the aforementioned function of the temperature-sensitive magnetic member 64. Accordingly, the heat radiation path is configured so that the temperature-sensitive magnetic member 64 and the other members arranged inside the temperature-sensitive magnetic member 64 (for example, the induction member 66) keep the non-contact state. Specifically, by existence of air space as a part of the heat radiation path, heat from the temperature-sensitive magnetic member 64 via the heat radiation path is prevented from excessively flowing out. Thereby, in a case where, for example, heat generated in the temperature-sensitive magnetic member 64 is accumulated such as a case where a large amount of image formation is successively performed, the heat radiation path functions as the one in order to easily radiate, from the temperature-sensitive magnetic member 64, the amount of heat corresponding to the heat generation by increase in the temperature exceeding the temperature of the fixing belt 61.

First Exemplary Embodiment

A description will be given of the first exemplary embodiment of the heat radiation path that radiates heat generated in the temperature-sensitive magnetic member 64 toward the inner direction of the temperature-sensitive magnetic member 64.

Figures 12A, 12B, 12C:
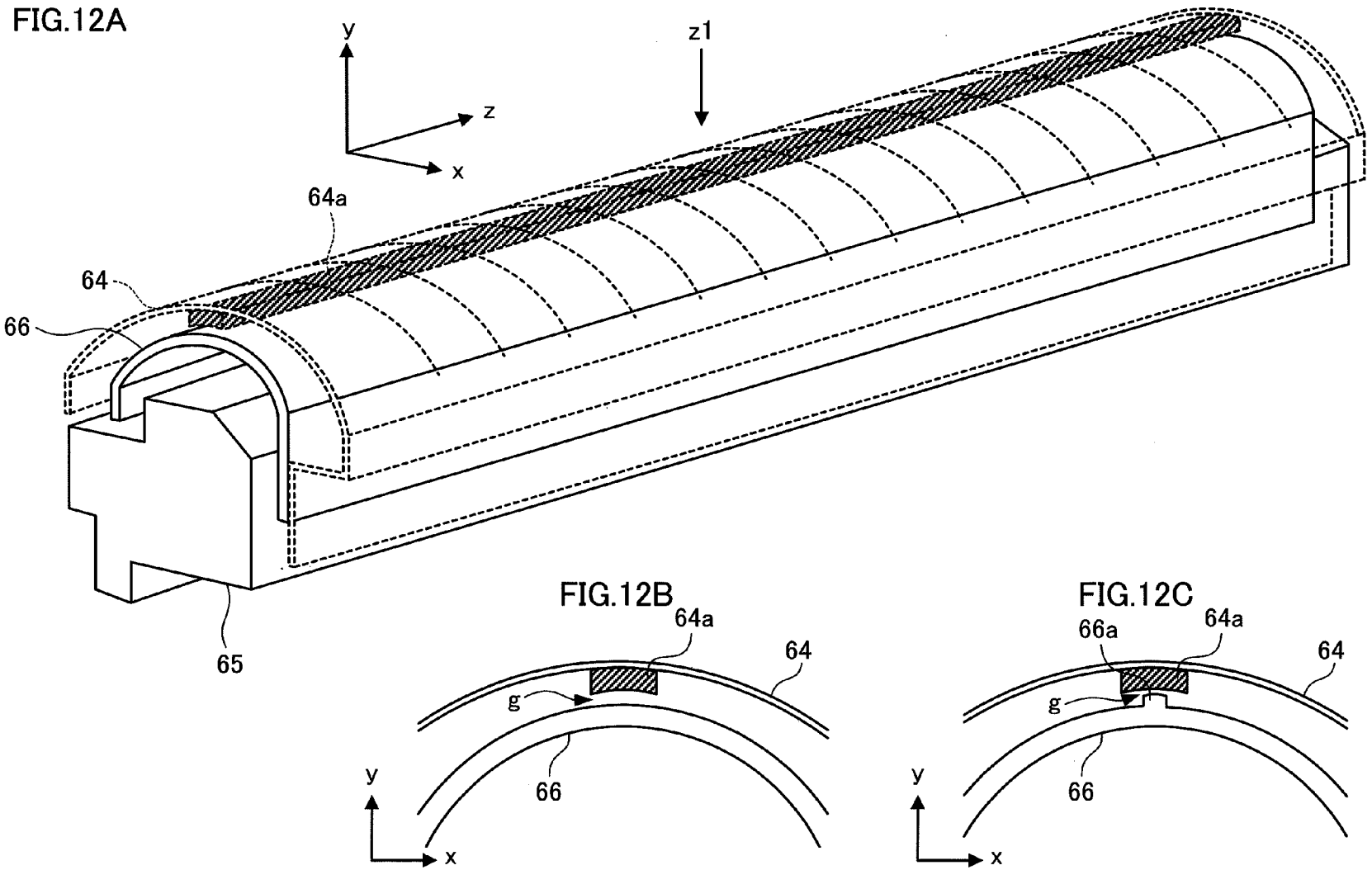
FIGS. 12A to 12C are views for explaining the heat radiation path in the first exemplary embodiment.

FIGS. 12A to 12C are views for explaining the heat radiation path in the first exemplary embodiment. FIG. 12A is a perspective view in a state where the temperature-sensitive magnetic member 64 and the induction member 66 are arranged on the holder 65, FIG. 12B is a cross sectional view of an x-y plane at a coordinate point z1 in the z axis direction in FIG. 12A, and FIG. 12C is a view showing a modified example of the heat radiation path in the first exemplary embodiment.

Note that, in FIGS. 12A to 12C, the z axis direction denotes the longitudinal direction of the holder 65, and the x-y plane denotes a plane orthogonal to the z axis direction. The same is true in the following FIGS. 13A to 17C.

As shown in FIGS. 12A and 12B, a heat radiation member 64*a* is arranged on the inner circumferential surface of the temperature-sensitive magnetic member 64 toward the induction member 66. Here, the heat radiation member 64*a* is formed of, for example, a metal material, a resin material having metallic particles dispersed therein, or the like, which has excellence in a heat transfer property.

The heat radiation member 64*a* is formed into a convex shape projecting from the inner circumferential surface of the temperature-sensitive magnetic member 64, and, as shown in FIG. 12A, the heat radiation member 64*a* is arranged over the entire region of the temperature-sensitive magnetic member 64 in the longitudinal direction (z direction). Further, as shown in FIG. 12B, the heat radiation member 64*a* is formed so as not to be in contact with the induction member 66, and air space g is interposed between the heat radiation member

64*a* and the induction member 66. Note that, the heat radiation member 64*a* may be integrally formed with the temperature-sensitive magnetic member 64 or independently formed.

As described above, since the heat radiation member 64*a* formed into the convex shape and the induction member 66 are close to each other, the heat of the temperature-sensitive magnetic member 64 easily flows from the heat radiation member 64*a* to the induction member 66. On the other hand, heat transfer rate of the (static) air space g is 0.024 W/mK, and this value is extremely smaller than that of a metal (having several tens of W/mk to several hundreds of W/mK) or the like. Thereby, since the air space g is interposed therebetween, the heat of the temperature-sensitive magnetic member 64 is not easily transferred to the induction member 66.

In this respect, the length of the heat radiation member 64*a* in the width direction (x direction) and a gap of the air space g are set so as to correspond to the configuration of the fixing unit 60, and thereby the heat radiation path that causes the temperature-sensitive magnetic member 64 to radiate the amount of heat corresponding to the increase in temperature exceeding the temperature of the fixing belt 61 is formed in a case where heat is accumulated in the temperature-sensitive magnetic member 64 such as a case where a large amount of image formation is successively performed.

In other words, the length of the heat radiation member 64*a* in the width direction (x direction) and the gap of the air space g are set so that the amount of heat radiation from the temperature-sensitive magnetic member 64 toward the induction member 66 is balanced with the amount of heat (Joule heat) generated in the temperature-sensitive magnetic member 64.

In this case, as shown in FIG. 12C, at a position of the induction member 66, which faces the heat radiation member 64*a*, a heat induction member 66*a* formed into a convex shape projecting from the outer circumferential surface of the induction member 66 may be provided. The heat induction member 66*a* is also arranged over the entire region of the induction member 66 in the longitudinal direction (z direction). By arranging the heat induction member 66*a* on the induction member 66 side, the surface area on the induction member 66 side, which faces the heat radiation member 64*a*, increases, and thus heat radiated from the heat radiation member 64*a* and transferred to the air space g is easily absorbed on the induction member 66 side. Accordingly, the heat from the temperature-sensitive magnetic member 64 to the induction member 66 through the air space g more smoothly flows, and heat, which corresponds to the increase in temperature exceeding the temperature of the fixing belt 61, is promptly transferred from the temperature-sensitive magnetic member 64.

Note that, the heat induction member 66*a* may be integrally formed with the induction member 66, or independently formed.

Incidentally, on the inner circumferential surface side of the temperature-sensitive magnetic member 64, the holder 65 having a large heat capacity is also arranged. Thus, even if the amount of heat from the temperature-sensitive magnetic member 64, which corresponds to self-heating of the temperature-sensitive magnetic member 64, is transferred to the induction member 66, the heat of the induction member 66 is further transferred to the holder 65 having the large heat capacity. Therefore, the temperature of the induction member 66 hardly changes. Accordingly, heat flows stably from the heat radiation member 64*a* to the induction member 66.

Second Exemplary Embodiment

A description will be given of the second exemplary embodiment of the heat radiation path for radiating heat generated in the temperature-sensitive magnetic member 64 toward the inner direction of the temperature-sensitive magnetic member 64.

Figures 13A, 13B, 13C:
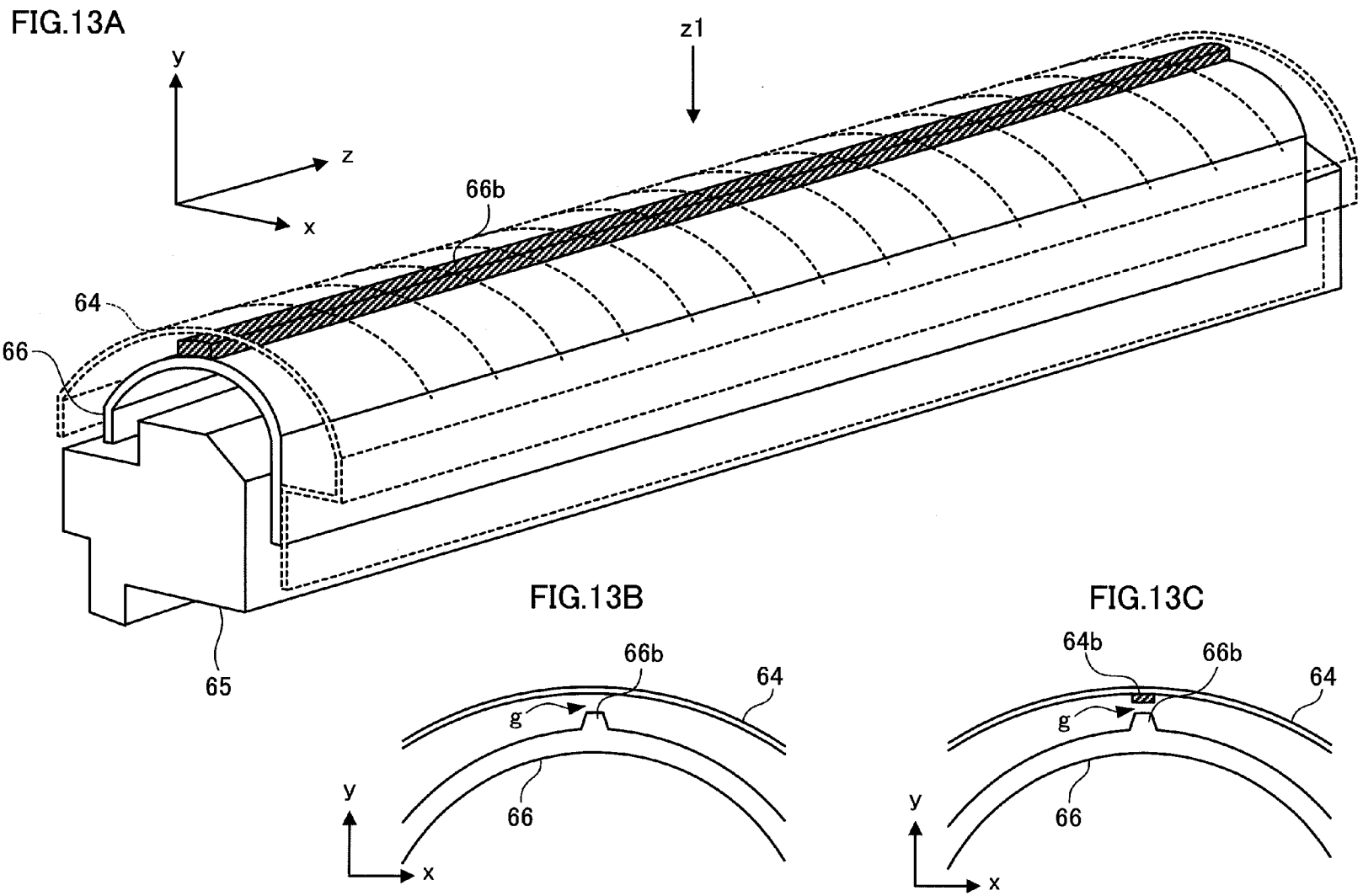
FIGS. 13A to 13C are diagrams for explaining the heat radiation path in the second exemplary embodiment.

FIGS. 13A to 13C are diagrams for explaining the heat radiation path in the second exemplary embodiment. FIG. 13A is a perspective view in a state where the temperature-sensitive magnetic member 64 and the induction member 66 are arranged on the holder 65, FIG. 13B is a cross sectional view of an x-y plane at a coordinate point z1 in the z axis direction in FIG. 13A, and FIG. 13C is a view showing a modified example of the heat radiation path in the second exemplary embodiment.

As shown in FIGS. 13A and 13B, on the outer circumferential surface of the induction member 66, a heat induction member 66*b* forming as a part of the induction member 66 is arranged toward the temperature-sensitive magnetic member 64. Here, the induction member 66 is made of a non-magnetic metal such as Ag, Cu or Al.

The heat induction member 66*b* is formed into a convex shape projecting from the outer circumferential surface of the induction member 66, and is arranged over the entire region of the induction member 66 in the longitudinal direction (z direction), as shown in FIG. 13A. Additionally, as shown in FIG. 13B, the heat induction member 66*b* is configured so as not to be in contact with the temperature-sensitive magnetic member 64, and air space g is interposed between the heat induction member 66*b* and the temperature-sensitive magnetic member 64.

As described above, since the heat induction member 66*b* formed into the convex shape and the temperature-sensitive magnetic member 64 are close to each other, heat of the temperature-sensitive magnetic member 64 easily flows from the surface of the temperature-sensitive magnetic member 64 toward the heat induction member 66*b*. On the other hand, the air space g having an extremely small heat transfer rate is interposed therebetween, and thereby the heat of the temperature-sensitive magnetic member 64 is difficult to be transferred to the heat induction member 66*b*.

In this respect, the length of the heat induction member 66*b* in the width direction (x direction) and a gap of the air space g are set so as to correspond to the configuration of the fixing unit 60, and thereby a heat radiation path that causes the temperature-sensitive magnetic member 64 to radiate the amount of heat corresponding to increase in temperature exceeding the temperature of the fixing belt 61 is formed in a case where heat is accumulated in the temperature-sensitive magnetic member 64 such as a case where a large amount of image formation is successively performed.

In other words, the length of the heat radiation member 66*b* in the width direction (x direction) and the gap of the air space g are set so that the amount of heat radiation from the temperature-sensitive magnetic member 64 toward the induction member 66 is balanced with the amount of heat (Joule heat) generated in the temperature-sensitive magnetic member 64.

In this case, similarly to the aforementioned heat radiation path in the first exemplary embodiment, a heat radiation member 64*b* may be arranged at a position of the inner circumferential surface of the temperature-sensitive magnetic member 64, which faces the heat induction member 66*b*, as shown in FIG. 13C. Here, the heat radiation member 64*b* is made of a metal material, a resin material having metallic particles dispersed therein or the like, which has a heat transfer property.

Third Exemplary Embodiment

A description will be given of the third exemplary embodiment of the heat radiation path for radiating heat generated in the temperature-sensitive magnetic member 64 toward the inner direction of the temperature-sensitive magnetic member 64.

Figures 14A, 14B, 14C:
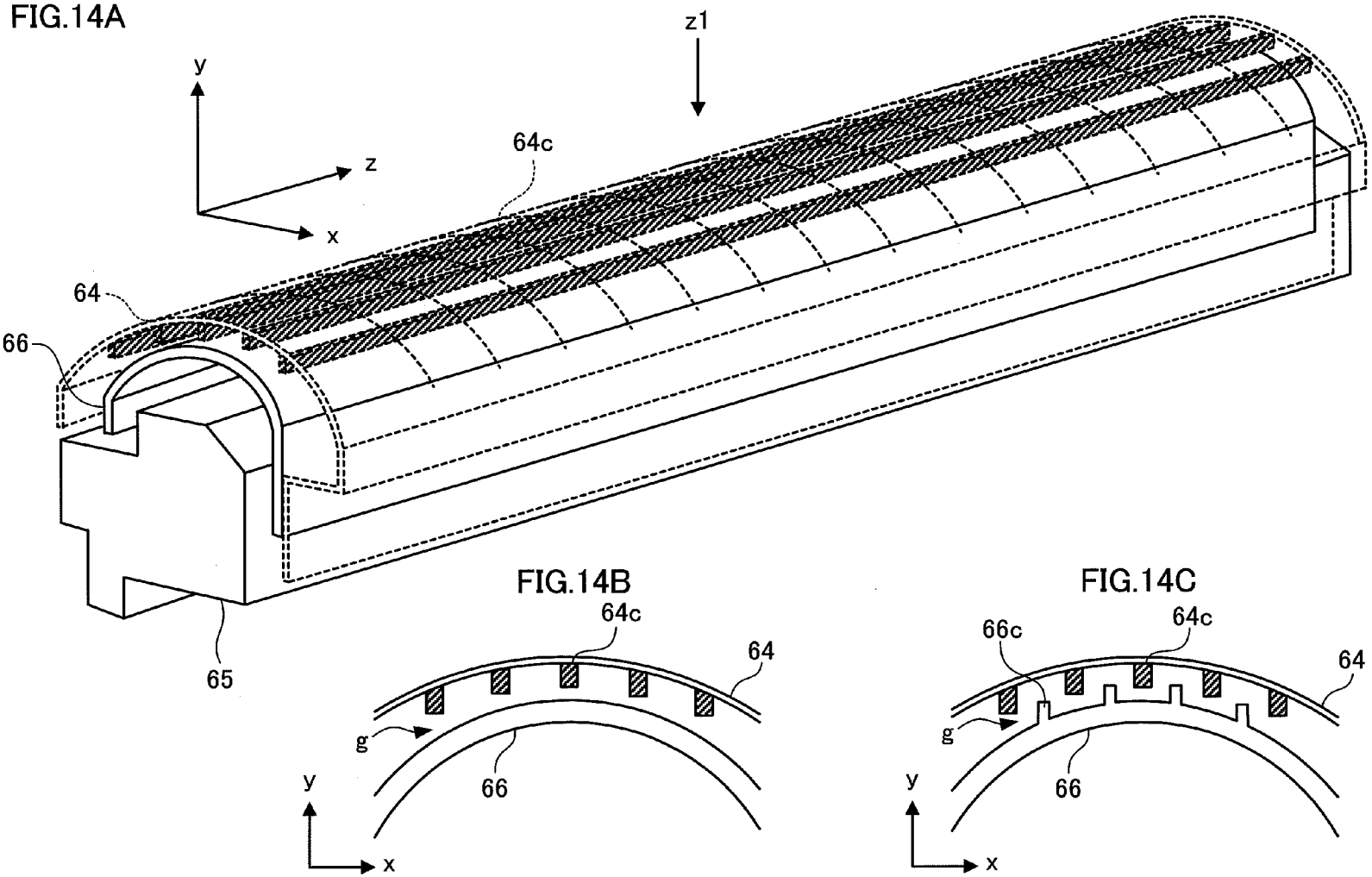
FIGS. 14A to 14C are diagrams for explaining the heat radiation path in the third exemplary embodiment.

FIGS. 14A to 14C are diagrams for explaining the heat radiation path in the third exemplary embodiment. FIG. 14A is a perspective view in a state where the temperature-sensitive magnetic member 64 and the induction member 66 are arranged on the holder 65, FIG. 14B is a cross sectional view of an x-y plane at a coordinate point z1 in the z axis direction in FIG. 14A, and FIG. 14C is a view showing a modified example of the heat radiation path in the third exemplary embodiment.

As shown in FIGS. 14A and 14B, multiple heat radiation fins 64*c* are arranged on the inner circumferential surface of the temperature-sensitive magnetic member 64 toward the induction member 66. Here, the heat radiation fins 64*c* are formed of, for example, a metal material, a resin material having metallic particles dispersed therein, or the like, which has a heat transfer property.

The heat radiation fins 64*c* are each formed as a board projecting from the inner circumferential surface of the temperature-sensitive magnetic member 64, and, as shown in FIG. 14A, the heat radiation fins 64*c* are arranged over the entire region of the temperature-sensitive member 64 in the longitudinal direction (z direction). Further, the multiple heat radiation fins 64*c* (for example, five heat radiation fins 64*c*) are arranged in the width direction (x direction) of the temperature-sensitive magnetic member 64. Furthermore, as shown in FIG. 14B, each of the heat radiation fins 64*c* is formed so as not to be in contact with the induction member 66, and air space g is interposed between each of the heat radiation fins 64*c* and the induction member 66. Note that, the heat radiation fins 64*c* may be integrally formed with the temperature-sensitive magnetic member 64 or independently formed.

As described above, since the heat radiation fins 64*c* each formed as the board and the induction member 66 are close to each other, the heat of the temperature-sensitive magnetic member 64 easily flows from the heat radiation fins 64*c* to the induction member 66. On the other hand, since the air space g having an extremely small heat transfer rate is interposed therebetween, the heat of the temperature-sensitive magnetic member 64 is not easily transferred to the induction member 66.

In this respect, the number of the heat radiation fins 64*c*, an interval between the adjacent two heat radiation fins 64*c* and a gap of the air space g are set so as to correspond to the configuration of the fixing unit 60, and thereby the heat radiation path that causes the temperature-sensitive magnetic member 64 to radiate the amount of heat corresponding to the increase in temperature exceeding the temperature of the fixing belt 61 is formed in a case where heat is accumulated in the temperature-sensitive magnetic member 64 such as a case where a large amount of image formation is successively performed.

In other words, the number of the heat radiation fins 64*c*, the interval between the adjacent two heat radiation fins 64*c* and the gap of the air space g are set so that the amount of heat radiation from the temperature-sensitive magnetic member 64 toward the induction member 66 is balanced with the amount of heat (Joule heat) generated in the temperature-sensitive magnetic member 64.

As described above, by providing the heat radiation fins 64*c*, an airflow in the longitudinal direction (z direction) of the temperature-sensitive magnetic member 64 is formed on the inner side of the temperature-sensitive magnetic member 64, in addition to the heat radiation from the temperature-sensitive magnetic member 64 to the induction member 66. Thereby, this configuration also functions so that the temperature distribution in the longitudinal direction (z direction) of the temperature-sensitive magnetic member 64 becomes uniform.

In this case, similarly to the aforementioned heat radiation path in the first exemplary embodiment, multiple heat induction fins 66*c* each formed as a board and formed as a part of the induction member 66 may be arranged on the outer surface of the induction member 66 so as to alternately arranged with the heat radiation fins 64*c* provided to the temperature-sensitive magnetic member 64, as shown in FIG. 14C. Here, the induction member 66 is made of a non-magnetic metal such as Ag, Cu or Al.

Fourth Exemplary Embodiment

A description will be given of the fourth exemplary embodiment of the heat radiation path for radiating heat generated in the temperature-sensitive magnetic member 64 toward the inner direction of the temperature-sensitive magnetic member 64.

Figures 15A, 15B, 15C:
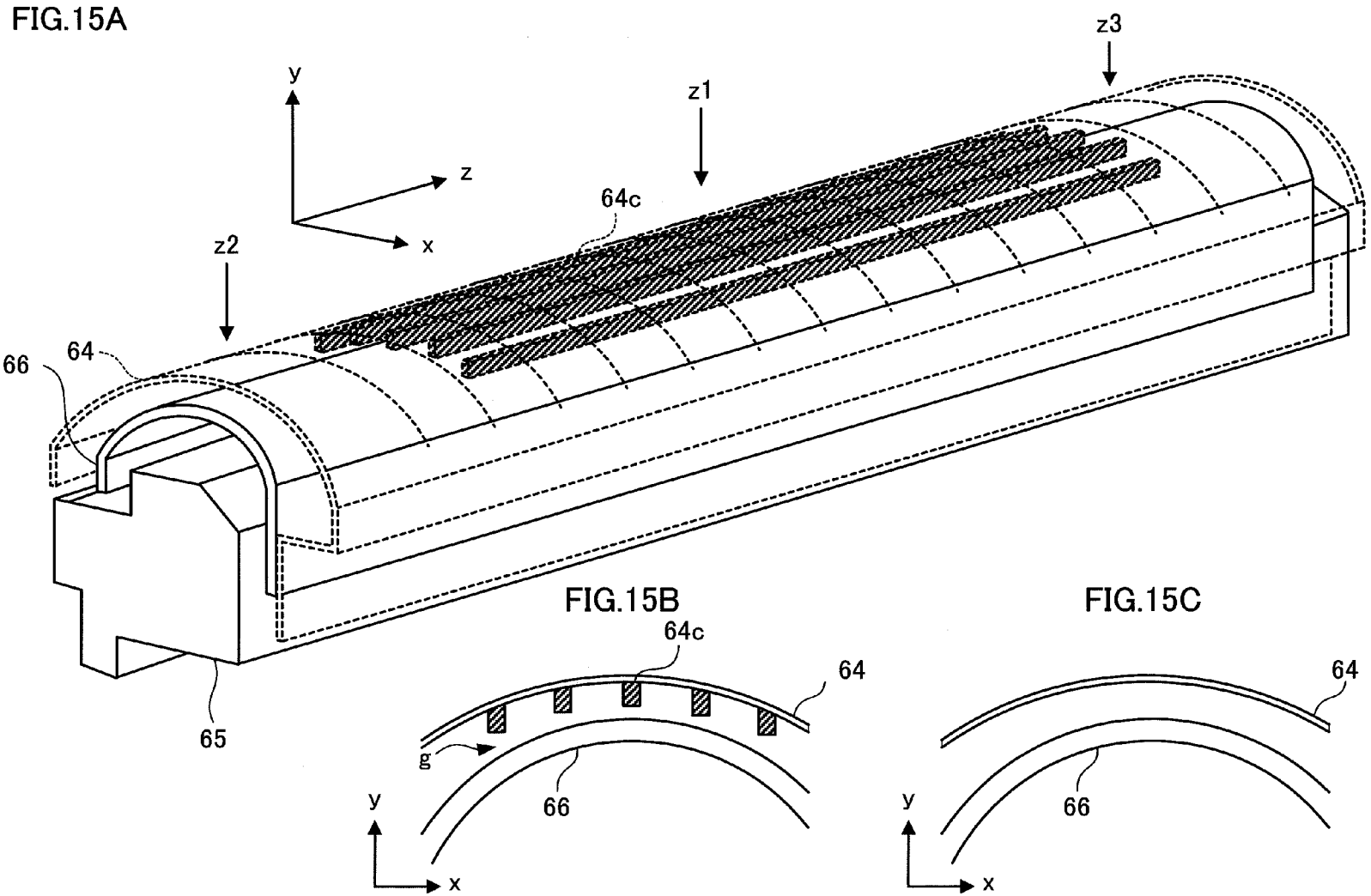
FIGS. 15A to 15C are diagrams for explaining the heat radiation path in the fourth exemplary embodiment.

FIGS. 15A to 15C are diagrams for explaining the heat radiation path in the fourth exemplary embodiment. FIG. 15A is a perspective view in a state where the temperature-sensitive magnetic member 64 and the induction member 66 are arranged on the holder 65, FIG. 15B is a cross sectional view of an x-y plane at a coordinate point A in the z axis direction in FIG. 15A, and FIG. 15C is a cross sectional view of the x-y plane at each of coordinate points z2 and z3 in the z axis direction in FIG. 15A.

As shown in FIG. 15A, in the fourth exemplary embodiment, the aforementioned heat radiation path in the third exemplary embodiment is arranged on a part corresponding to, for example, a region (small size sheet passing region Fs) where a small size sheet P1 having a smaller width than the maximum size sheet P shown in FIG. 9 passes (for example, A4 longitudinal feed) (FIG. 15B), and is not arranged on a part corresponding to the non-sheet passing regions Fb where the small size sheet P1 does not pass (FIG. 15C).

Even in a case where any size sheet P is used in the fixing unit 60, the small size sheet passing region Fs where the sheet P passes is a region having a high frequency of sequential sheet passage. Therefore, the small size sheet passing region Fs has a higher possibility that the temperature of the temperature-sensitive magnetic member 64 exceeds the permeability change start temperature whereas the temperature of the fixing belt 61 does not exceed the permeability change start temperature, than the other regions. Accordingly, the heat radiation path in the third exemplary embodiment is arranged on a part corresponding to the small size sheet passing region Fs in order to suppress increase in the temperature of the temperature-sensitive magnetic member 64 especially at the small size sheet passing region Fs.

Fifth Exemplary Embodiment

A description will be given of the fifth exemplary embodiment of the heat radiation path for radiating heat generated in the temperature-sensitive magnetic member 64 toward the inner direction of the temperature-sensitive magnetic member 64.

Figure 16A:
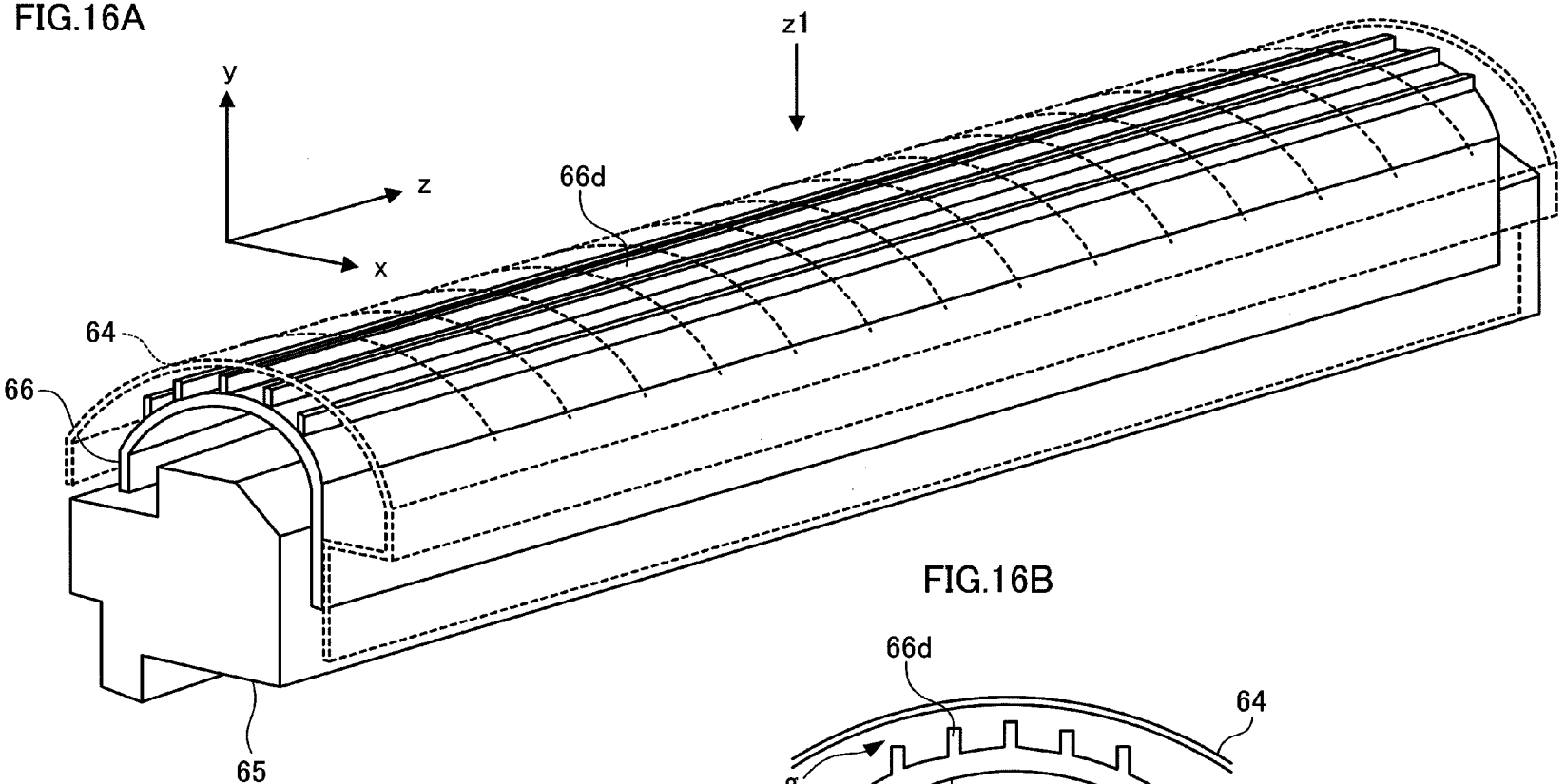
FIGS. 16A and 16B are diagrams for explaining the heat radiation path in the fifth exemplary embodiment.
Figure 16B:
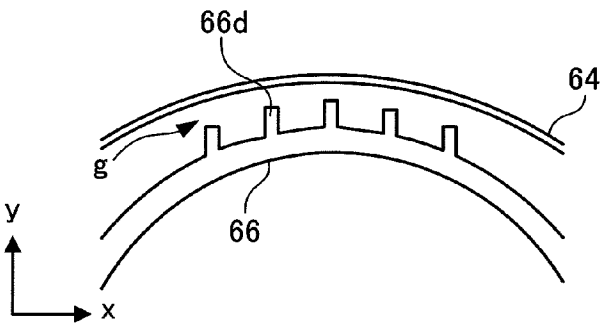

FIGS. 16A and 16B are diagrams for explaining the heat radiation path in the fifth exemplary embodiment. FIG. 16A is a perspective view in a state where the temperature-sensitive magnetic member 64 and the induction member 66 are arranged on the holder 65, and FIG. 16B is a cross sectional view of an x-y plane at a coordinate point z1 in the z axis direction in FIG. 16A.

As shown in FIGS. 16A and 16B, multiple heat radiation fins 66*d* are arranged on the induction member 66 arranged on the inner circumferential surface side of the temperature-sensitive magnetic member 64, toward the temperature-sensitive magnetic member 64. Here, the heat radiation fins 66*d* are made of, for example, a metal material, a resin material having metallic particles dispersed therein or the like, which has heat transfer property.

The heat radiation fins 66*d* are boards projecting from the outer circumferential surface of the induction member 66, and are arranged over the induction member 66 in the longitudinal direction (z direction), as shown in FIG. 16A. Moreover, the multiple heat radiation fins 66*d*. (for example, five heat radiation fins 66*d*) are arranged in the width direction (x direction) of the induction member 66*d*. In addition, as shown in FIG. 16B, each of the heat radiation fins 66*d* is configured so as not to be in contact with the temperature-sensitive magnetic member 64, and air space g is interposed between each of the heat radiation fins 66*d* and the temperature-sensitive magnetic member 64. Note that, the heat radiation fins 66*d* may be integrally formed with the induction member 66, or may be independently formed.

As described above, since each of the heat radiation fins 66*d* formed as the board and the temperature-sensitive magnetic member 64 are close to each other, heat of the temperature-sensitive magnetic member 64 easily flows toward the induction member 66 via the heat radiation fins 66*d*. On the other hand, since the air space g having the extremely small heat transfer rate is interposed therebetween, and thus the heat of the temperature-sensitive magnetic member 64 is not easily transferred to the induction member 66.

In this respect, the number of the heat radiation fins 66*d*, an interval between the adjacent two heat radiation fins 66*c*1, and a gap of the air space g are set so as to correspond to the configuration of the fixing unit 60, and thereby a heat radiation path that causes the temperature-sensitive magnetic member 64 to radiate the amount of heat corresponding to increase in temperature exceeding the temperature of the fixing belt 61 is formed in a case where heat is accumulated in the temperature-sensitive magnetic member 64 such as a case where a large amount of image formation is successively performed.

In other words, the number of the heat radiation fins 66*d*, the interval between the adjacent two heat radiation fins 66*d*, and the gap of the air space g are set so that the amount of heat radiation from the temperature-sensitive magnetic member 64 toward the induction member 66 is balanced with the amount of heat (Joule heat) generated in the temperature-sensitive magnetic member 64.

As described above, by providing the heat radiation fins 66*d* to the induction member 66, airflow in the longitudinal direction (z direction) of the temperature-sensitive magnetic member 64 is formed on the inner side of the temperature-sensitive magnetic member 64, in addition to the heat radiation from the temperature-sensitive magnetic member 64 toward the induction member 66. Thereby, the heat radiation fins 66*d* also functions so that the temperature distribution in the longitudinal direction (z direction) of the temperature-sensitive magnetic member 64 becomes uniform.

Sixth Exemplary Embodiment

A description will be given of the sixth exemplary embodiment of the heat radiation path for radiating heat generated in the temperature-sensitive magnetic member 64 toward the inner direction of the temperature-sensitive magnetic member 64.

Figures 17A, 17B, 17C:
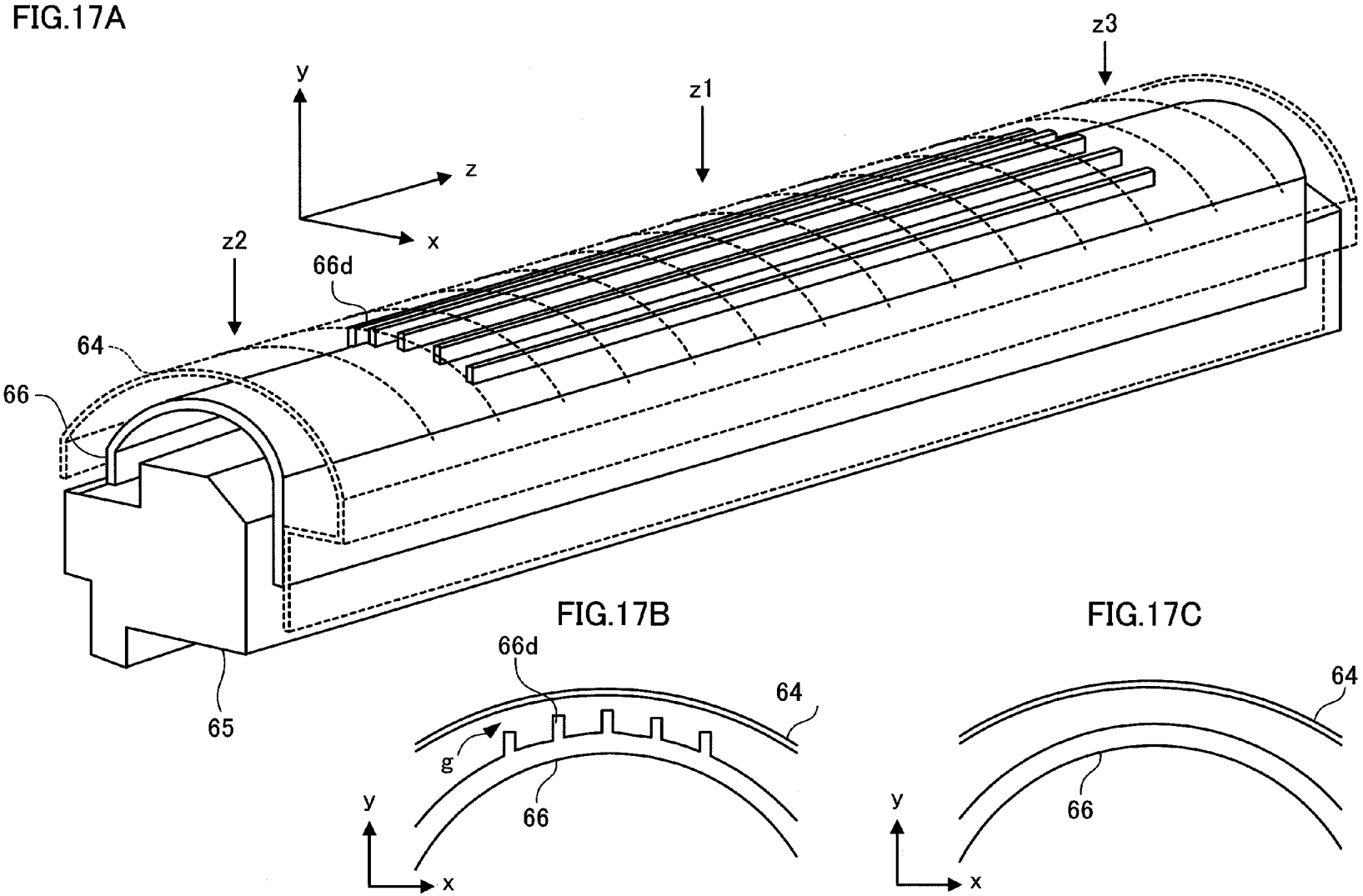
FIGS. 17A to 17C are diagrams for explaining the heat radiation path in the sixth exemplary embodiment.

FIGS. 17A to 17C are diagrams for explaining the heat radiation path in the sixth exemplary embodiment. FIG. 17A is a perspective view in a state where the temperature-sensitive magnetic member 64 and the induction member 66 are arranged on the holder 65, FIG. 17B is a cross sectional view of an x-y plane at a coordinate point z1 in the z axis direction in FIG. 17A, and FIG. 17C is a cross sectional view of the x-y plane at each of coordinate points z2 and z3 in the z axis direction in FIG. 17A.

As shown in FIG. 17A, in the sixth exemplary embodiment, the aforementioned heat radiation path in the fifth exemplary embodiment is arranged on a part corresponding to, for example, a region (small size sheet passing region Fs) where a small size sheet P1 having a smaller width than the maximum size sheet P shown in FIG. 9 passes (for example, A4 longitudinal feed) (FIG. 17B), and is not arranged on a part corresponding to the non-sheet passing regions Fb where the small size sheet P1 does not pass (FIG. 17C).

Even in a case where any size sheet P is used in the fixing unit 60, the small size sheet passing region Fs where the sheet P passes is a region having a high frequency of sequential sheet passage. Therefore, the small size sheet passing region Fs has a higher possibility that the temperature of the temperature-sensitive magnetic member 64 exceeds the permeability change start temperature whereas the temperature of the fixing belt 61 does not exceed the permeability change start temperature, than the other regions. Accordingly, the heat radiation path in the fifth exemplary embodiment is arranged on a part corresponding to the small size sheet passing region Fs in order to suppress increase in the temperature of the temperature-sensitive magnetic member 64 especially at the small size sheet passing region Fs.

As described above, in the fixing unit 60 provided to the image forming apparatus 1 in these exemplary embodiments, the temperature-sensitive magnetic member 64 is arranged so as to be close to the inner circumferential surface of the fixing belt 61. Moreover, the heat radiation path for radiating heat generated in the temperature-sensitive magnetic member 64 in the inner direction of the temperature-sensitive magnetic member 64. By this configuration, the temperature of the non-sheet passing region Fb is suppressed to excessively increase. In addition, the temperature of the temperature-sensitive magnetic member 64 is suppressed to exceed the permeability change start temperature in a state where the temperature of the fixing belt 61 does not exceed the permeability change start temperature, and a state where the fixing belt 61 is sufficiently heated up to the fixation setting temperature at the sheet passing region is kept.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that has a conductive layer, and that fixes toner onto a recording medium by heat generation of the conductive layer through electromagnetic induction;

a magnetic field generating member that generates an alternate-current magnetic field crossing the conductive layer of the fixing member;

a magnetic path forming member that is arranged so as to face the magnetic field generating member through the fixing member, that forms a magnetic path of the alternate-current magnetic field generated by the magnetic field generating member within a temperature range not greater than a permeability change start temperature at which permeability starts to decrease, and that causes the alternate-current magnetic field generated by the magnetic field generating member to go through the magnetic path forming member within a temperature range exceeding the permeability change start temperature; and a heat radiation member that is arranged to be in contact with the magnetic path forming member in order to radiate heat generated in the magnetic path forming member toward a direction opposite to the fixing member with reference to the magnetic path forming member.

2. The fixing device according to claim 1, wherein the heat radiation member is made of a material having high heat conductivity, the material is different from a material of the magnetic path forming member.

3. The fixing device according to claim 1, further comprising a heat induction member that faces the heat radiation member through air space located on an opposite side of the magnetic path forming member.

4. The fixing device according to claim 1, wherein the heat radiation member is arranged at a region in a width direction of the fixing member, where a recording medium having a minimum size included in the recording medium to be used passes.

5. The fixing device according to claim 1, wherein the magnetic path forming member includes an eddy current controlling portion that decreases an eddy current size generated by the alternate-current magnetic field generated by the magnetic field generating member.

6. An image forming apparatus comprising:

a toner image forming unit that forms a toner image;

a transfer unit that transfers, onto a recording medium, the toner image formed by the toner image forming unit; and the fixing device described in claim 1 that fixes, onto the recording medium, the toner image transferred onto the recording medium.

7. The image forming apparatus according to claim 6, wherein the heat radiation member of the fixing device is made of a material having high heat conductivity, the material is different from a material of the magnetic path forming member of the fixing device.

8. The image forming apparatus according to claim 6, wherein the fixing device further comprises a heat induction member that faces the heat radiation member of the fixing device through air space located on an opposite side of the magnetic path forming member of the fixing device.

9. The image forming apparatus according to claim 6, wherein the heat radiation member of the fixing device is arranged at a region in a width direction of the fixing member, where a recording medium having a minimum size included in the recording medium to be used passes.

10. The image forming apparatus according to claim 6, wherein the magnetic path forming member of the fixing device includes an eddy current controlling portion that decreases an eddy current size generated by the alternate-current magnetic field generated by the magnetic field generating member of the fixing device.

11. A fixing device comprising:

a fixing member that has a conductive layer, and that fixes toner onto a recording medium by heat generation of the conductive layer through electromagnetic induction;

a magnetic field generating member that generates an alternate-current magnetic field crossing the conductive layer of the fixing member;

a magnetic path forming member that is arranged so as to face the magnetic field generating member through the fixing member, that forms a magnetic path of the alternate-current magnetic field generated by the magnetic field generating member within a temperature range not greater than a permeability change start temperature at which permeability starts to decrease, and that causes the alternate-current magnetic field generated by the magnetic field generating member to go through the magnetic path forming member within a temperature range exceeding the permeability change start temperature;

an induction member that is arranged on a side of the magnetic path forming member, the side being opposite to the fixing member, and that induces, into the induction member, the alternate-current magnetic field going through the magnetic path forming member; and a heat radiation member that is arranged on a face of the induction member, the face facing the magnetic path forming member, so as to spread in any one of a whole region and a part of the region in a longitudinal direction of the induction member, and that radiates heat generated in the magnetic path forming member.

12. The fixing device according to claim 11, wherein the heat radiation member is made of a material having high heat conductivity, the material is different from a material of the magnetic path forming member.

13. The fixing device according to claim 11, wherein the heat radiation member is arranged at a region in a width direction of the fixing member, where a recording medium having a minimum size included in the recording medium to be used passes.

* * * * *